US010563894B2

(12) United States Patent
Ito et al.

(10) Patent No.: US 10,563,894 B2
(45) Date of Patent: Feb. 18, 2020

(54) REFRIGERATION CYCLE APPARATUS

(71) Applicant: Mitsubishi Electric Corporation, Tokyo (JP)

(72) Inventors: Masahiro Ito, Tokyo (JP); Kosuke Tanaka, Tokyo (JP); Takuya Ito, Tokyo (JP); Yasushi Okoshi, Tokyo (JP); Kazuyuki Ishida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 84 days.

(21) Appl. No.: 15/750,937

(22) PCT Filed: Aug. 28, 2015

(86) PCT No.: PCT/JP2015/074365
§ 371 (c)(1),
(2) Date: Feb. 7, 2018

(87) PCT Pub. No.: WO2017/037771
PCT Pub. Date: Mar. 9, 2017

(65) Prior Publication Data

US 2018/0231286 A1 Aug. 16, 2018

(51) Int. Cl.
*F25B 47/02* (2006.01)
*F25B 13/00* (2006.01)

(52) U.S. Cl.
CPC ..... *F25B 47/02* (2013.01); *F25B 13/00* (2013.01); *F25B 2700/04* (2013.01)

(58) Field of Classification Search
CPC ..... F25B 13/00; F25B 45/00; F25B 47/02; F25B 47/025; F25B 2345/001;
(Continued)

(56) References Cited

U.S. PATENT DOCUMENTS

2012/0111042 A1 5/2012 Hamada et al.
2015/0267951 A1* 9/2015 Berg ..... F25B 45/00 62/77

(Continued)

FOREIGN PATENT DOCUMENTS

EP 2458305 A1 5/2012
JP 4001149 B 11/2006

(Continued)

OTHER PUBLICATIONS

Extended European Search Report dated Aug. 14, 2018 issued in corresponding EP patent application No. 15902897.6.

(Continued)

*Primary Examiner* — Marc E Norman
(74) *Attorney, Agent, or Firm* — Posz Law Group, PLC

(57) ABSTRACT

In a refrigeration cycle apparatus, a controller is configured to, when a defrost mode is started, control a first pressure reducing device is controlled to adjust a flow rate of refrigerant to bring a degree of superheat of the refrigerant at a suction side of a compressor close to a target value, control a flow path switching device to form a first flow path through which the refrigerant released from the compressor flows to a first heat exchanger; perform a refrigerant release operation of opening one of a second pressure reducing device and a valve and closing the other of the second pressure reducing device and the valve, and perform a refrigerant collection operation of opening the second pressure reducing device and the valve, with the flow path switching device retained to form the first flow path, after the refrigerant release operation.

11 Claims, 15 Drawing Sheets

(58) Field of Classification Search
CPC ..... F25B 2345/002; F25B 2345/003; F25B 2400/19; F25B 2600/21; F25B 2600/2513; F25B 2600/2523
See application file for complete search history.

(56) References Cited

U.S. PATENT DOCUMENTS

| | | | | |
|---|---|---|---|---|
| 2018/0252449 | A1* | 9/2018 | Ito | F25B 13/00 |
| 2019/0154322 | A1* | 5/2019 | Ito | F25B 13/00 |

FOREIGN PATENT DOCUMENTS

| | | | | |
|---|---|---|---|---|
| JP | 2009-236447 | A | 10/2009 | |
| JP | 2010-101570 | A | 5/2010 | |
| JP | 5401563 | B | 8/2011 | |
| JP | 2012-202606 | A | 10/2012 | |
| JP | 2014-119145 | A | 6/2014 | |
| JP | 2014-119153 | A | 6/2014 | |
| WO | 2006/115053 | A1 | 11/2006 | |
| WO | 2011/010473 | A1 | 1/2011 | |
| WO | 2011/099629 | A1 | 8/2011 | |
| WO | WO-2016139783 | A1 * | 9/2016 | F25B 1/00 |

OTHER PUBLICATIONS

International Search Report dated Nov. 17, 2015 issued in corresponding International Patent Application No. PCT/JP2015/074365.
Office action dated Jul. 31, 2018 issued in corresponding JP patent application No. 2017-537041 (and English translation thereof).
Office Action dated Aug. 2, 2019 issued in corresponding CN patent application No. 201580082560.9 (and English translation).

* cited by examiner

REFRIGERATION CYCLE APPARATUS

CROSS REFERENCE TO RELATED APPLICATION

This application is a U.S. national stage application of International Application No. PCT/JP2015/074365, filed on Aug. 28, 2015, the contents of which are incorporated herein by reference.

TECHNICAL FIELD

The present invention relates to a refrigeration cycle apparatus that is able to switch between a cooling mode and a heating mode.

BACKGROUND

Hitherto, a chilling unit has been proposed which includes a gas-liquid separator provided at the suction side of a compressor. In the chilling circuit, evaporated refrigerant is separated into gas refrigerant and liquid refrigerant by the gas-liquid separator, then sucked into the compressor, and compressed again (see, for example, Patent Literature 1).

PATENT LITERATURE

Patent Literature 1: Japanese Patent No. 5401563 (p. 10, FIG. 8)

In a refrigeration cycle apparatus, liquid refrigerant having passed through a pressure reducing device is made into gas refrigerant at a heat exchanger serving as an evaporator, and the gas refrigerant is sucked into a compressor. The refrigerant to be sucked by the compressor is ideally in a gas state. This is because, if liquid refrigerant is sucked into the compressor, there is a possibility that breakage of the compressor is caused, and the operation efficiency of a refrigeration cycle is decreased. There is also a refrigeration cycle apparatus that controls a pressure reducing device for a degree of superheat such that the degree of superheat at the outlet side of an evaporator, that is, at the suction side of a compressor is brought close to a target value, to prevent occurrence of liquid backflow in which liquid refrigerant is sucked into the compressor.

However, in a transient state caused in changing an operation mode or in starting the refrigeration cycle apparatus, refrigerant having passed through the evaporator may include liquid refrigerant. For example, there is a defrost mode in which frost adhering to a heat exchanger serving as an evaporator in the heating mode is melted. As a defrost mode, there is an operation mode in which the refrigerant is circulated in the same cycle as that in the cooling mode, that is, in a cycle opposite to that in the heating mode. In returning from such a defrost mode to the heating mode, high pressure and low pressure in the refrigerant circuit are inverted, and a heat exchanger having served as a condenser in the defrost mode serves as an evaporator in the heating mode. The evaporation ability is not stabilized immediately after return to the heating mode, and the refrigerant is not sufficiently gasified, so that liquid backflow may occur. Furthermore, in a refrigeration cycle apparatus that is able to switch between a cooling mode and a heating mode, refrigerant amounts required in both modes are different from each other. Thus, the capacity of a heat exchanger serving as a heat source side heat exchanger may be made larger than that of a heat exchanger serving as a load side heat exchanger. With such a configuration, a possibility of liquid backflow increases. Therefore, a refrigeration cycle apparatus has been desired in which refrigerant is sufficiently gasified at an evaporator and thus it is possible to inhibit liquid backflow.

In the apparatus disclosed in Patent Literature 1, flow of the refrigerant into the compressor is inhibited by providing an accumulator at the suction side of the compressor. Here, to inhibit flow of liquid refrigerant into the compressor, the volume of the accumulator is generally set at approximately 70% of the total amount of the refrigerant that circulates in the refrigeration cycle apparatus. The accumulator is generally installed in a machine chamber together with the compressor, a flow path switching device, and the like. Since the volume of the accumulator is large, the size of the machine chamber is also increased. The space of, for example, a roof floor or a dedicated lot on which the machine chamber is installed is limited, and thus a refrigeration cycle apparatus that is able to inhibit liquid backflow has been desired for reducing the size of the accumulator.

SUMMARY

The present invention has been made in view of the above-described problems, and an object of the present invention is to provide a refrigeration cycle apparatus that is able to inhibit liquid backflow also in a transient state of a refrigeration cycle.

A refrigeration cycle apparatus according to an embodiment of the present invention includes: a compressor; a first heat exchanger; a second heat exchanger connected in series with the first heat exchanger and having a capacity smaller than the first heat exchanger; a first pressure reducing device connected between the first heat exchanger and the second heat exchanger; a flow path switching device configured to form a first flow path through which refrigerant released from the compressor flows to the first heat exchanger in a cooling mode and a defrost mode, and form a second flow path through which the refrigerant released from the compressor flows to the second heat exchanger in a heating mode; a refrigerant tank circuit branching from between the first heat exchanger and the first pressure reducing device and joining between the first pressure reducing device and the second heat exchanger, being in parallel with the first pressure reducing device, and including, in series, a second pressure reducing device, a refrigerant tank, and a valve, the valve opening and closing a flow path between the refrigerant tank and the second heat exchanger; and a controller configured to control the flow path switching device, the second pressure reducing device, and the valve, when the defrost mode is started, the first pressure reducing device being configured to adjust a flow rate of the refrigerant to bring a degree of superheat of the refrigerant at a suction side of the compressor close to a target value, the controller being configured to control the flow path switching device to form the first flow path, perform a refrigerant release operation of opening one of the second pressure reducing device and the valve and closing an other of the second pressure reducing device and the valve, and perform a refrigerant collection operation of opening the second pressure reducing device and the valve, with the flow path switching device retained to form the first flow path after the refrigerant release operation.

According to one embodiment of the present invention, it is possible to inhibit liquid backflow to the compressor in returning from the defrost mode to the heating mode.

DETAILED DESCRIPTION

Refrigeration cycle apparatuses according to Embodiments of the present invention will be described with reference to the drawings. In each drawing, the relative dimensional relationship, or the shape, etc. of each component may be different from actual ones.

Embodiment 1

[Configuration of Refrigeration Cycle Apparatus]

Figure 1:
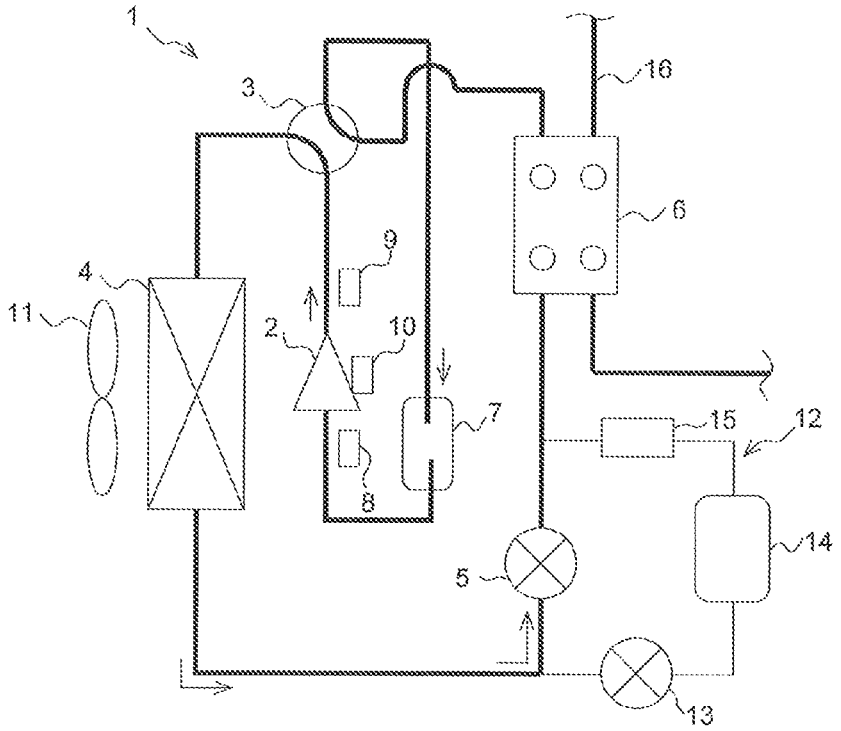
FIG. 1 is a circuit configuration diagram of a refrigeration cycle apparatus according to Embodiment 1 and illustrates a state in a cooling mode.
Figure 2:
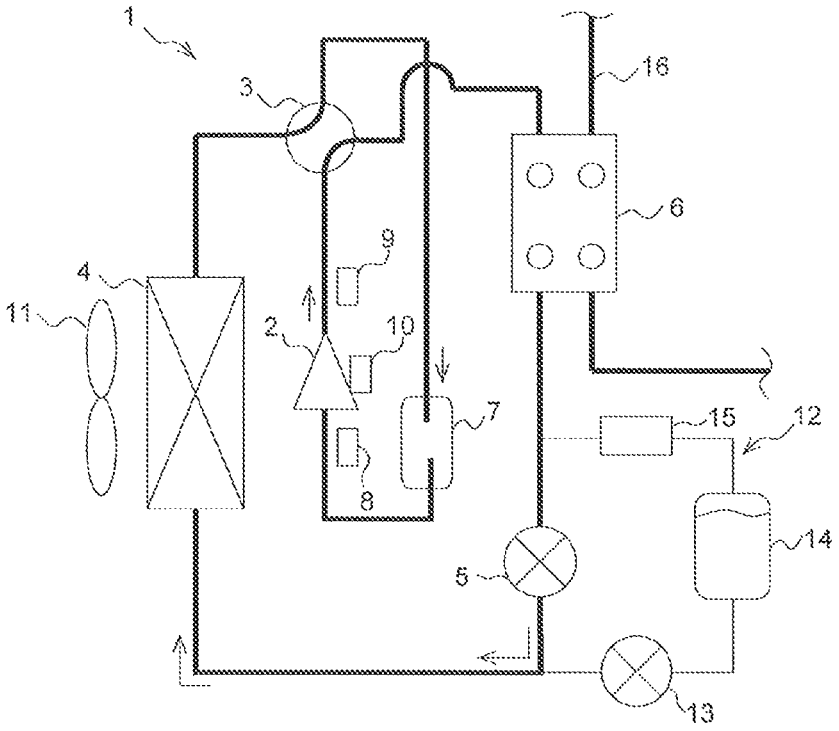
FIG. 2 is a circuit configuration diagram of the refrigeration cycle apparatus according to Embodiment 1 and illustrates a state in a heating mode.

FIG. 1 is a circuit configuration diagram of a refrigeration cycle apparatus according to Embodiment 1 and illustrates a state in a cooling mode. FIG. 2 is a circuit configuration diagram of the refrigeration cycle apparatus according to Embodiment 1 and illustrates a state in a heating mode. In FIGS. 1 and 2, a path through which refrigerant flows is indicated by thick lines, and a direction in which the refrigerant flows is indicated by arrows. As shown in FIGS. 1 and 2, the refrigeration cycle apparatus 1 has a refrigeration circuit in which a compressor 2, a flow path switching device 3 provided at the discharge side of the compressor 2, a first heat exchanger 4, a first pressure reducing device 5, a second heat exchanger 6, and an accumulator 7 are connected to each other by pipes. Refrigerant accompanying phase change, such as carbon dioxide or R410A, circulates in the refrigeration circuit. The refrigeration cycle apparatus 1, an example of which is described in Embodiment 1 serves as a part of a chilling unit in which water in a water circuit 16 heated or cooled by the second heat exchanger 6 is used, for example, for air-conditioning an indoor space.

The compressor 2 sucks low-pressure refrigerant, compresses the refrigerant, and discharges the refrigerant as high-pressure refrigerant. The compressor 2 is a compressor the refrigerant capacity of which is variable, for example, an inverter compressor. The amount of the refrigerant circulating in the refrigeration cycle apparatus 1 is controlled by adjusting the capacity of the compressor 2.

The first pressure reducing device 5 reduces the pressure of the high-pressure refrigerant. A device including a valve body the opening degree of which is adjustable, for example, an electronically controlled expansion valve may be used as the first pressure reducing device 5.

The flow path switching device 3 selectively performs: an operation of connecting the discharge side of the compressor 2 to the first heat exchanger 4 and connecting the suction side of the compressor 2 to the second heat exchanger 6 to form a first flow path through which the refrigerant released from the compressor 2 flows to the first heat exchanger 4; and an operation of connecting the discharge side of the compressor 2 to the second heat exchanger 6 and connecting the suction side of the compressor 2 to the first heat exchanger 4 to form a second flow path through which the refrigerant released from the compressor 2 flows to the second heat exchanger 6. The flow path switching device 3 is a device that has a valve body provided in the pipe through which the refrigerant flows and that switches between the above-described refrigerant flow paths by switching an opened/closed state of the valve body.

The first heat exchanger 4 is a refrigerant-air heat exchanger having a flow path through which the refrigerant flows. At the first heat exchanger 4, heat is exchanged between the refrigerant flowing through the flow path and air outside the flow path. A fan 11 is provided near the first heat exchanger 4, and the heat exchange at the first heat exchanger 4 is promoted by air sent from the fan 11. The fan 11 is, for example, a fan the rotation speed of which is variable, and the amount of heat received from the refrigerant at the first heat exchanger 4 is adjusted by adjusting the rotation speed of the fan 11.

The second heat exchanger 6 is a refrigerant-water heat exchanger having: a flow path through which the refrigerant flows; and a flow path through which water in the water circuit 16 flows. At the second heat exchanger 6, heat is exchanged between the refrigerant and the water.

The refrigeration cycle apparatus 1 is able to operate while switching between cooling and heating. In the cooling mode, the flow path switching device 3 allows the discharge side of the compressor 2 to communicate with the first heat exchanger 4 to form the first flow path through which the refrigerant released from the compressor 2 flows to the first heat exchanger 4, the first heat exchanger 4 serves as a condenser, and the second heat exchanger 6 serves as an evaporator. In the heating mode, the flow path switching device 3 allows the discharge side of the compressor 2 to communicate with the second heat exchanger 6 to form the second flow path through which the refrigerant released from the compressor 2 flows to the second heat exchanger 6, the first heat exchanger 4 serves as an evaporator, and the second heat exchanger 6 serves as a condenser. The first heat exchanger 4 serves as a heat source side heat exchanger, and the second heat exchanger 6 serves as a use side heat exchanger. In view of loads required in the cooling mode and in the heating mode, the heat exchange capacity of the first heat exchanger 4 is larger than that of the second heat exchanger 6.

The accumulator 7 is a container that stores the refrigerant therein, and is installed at the suction side of the compressor 2. A pipe through which the refrigerant flows into the accumulator 7 is connected to an upper portion of the accumulator 7, and a pipe through which the refrigerant flows out from the accumulator 7 is connected to a lower portion of the accumulator 7. The refrigerant is separated into gas refrigerant and liquid refrigerant within the accumulator 7. The gas refrigerant resultant from the gas-liquid separation is sucked into the compressor 2.

A suction pressure sensor 8 that detects the pressure of the refrigerant to be sucked into the compressor 2, that is, the pressure of the refrigerant at the low-pressure side, is provided at a suction portion of the compressor 2. The suction pressure sensor 8 is provided at a position that allows the pressure of the refrigerant at the low-pressure side to be detected, and the illustrated position of the suction pressure sensor 8 is an example.

A discharge pressure sensor 9 that detects the pressure of the refrigerant to be discharged from the compressor 2, that is, the pressure of the refrigerant at the high-pressure side, is provided at a discharge portion of the compressor 2. The discharge pressure sensor 9 is provided at a position that allows the pressure of the refrigerant at the high-pressure side to be detected, and the position of the illustrated discharge pressure sensor 9 is an example.

A suction temperature sensor 10 that detects the temperature of the refrigerant to be sucked into the compressor 2, that is, the temperature of the refrigerant at the low-pressure side, is provided at the suction portion of the compressor 2. The suction temperature sensor 10 is provided at a position that allows the temperature of the refrigerant at the low-pressure side to be detected, and the position of the illustrated suction temperature sensor 10 is an example. The suction temperature sensor 10 is provided, for example, at a lower portion of a shell of the compressor 2 or at a pipe at the inlet side of the accumulator 7.

A refrigerant tank circuit 12 is provided in the refrigeration cycle apparatus 1. The refrigerant tank circuit 12 is a circuit that connects between the first heat exchanger 4 and the first pressure reducing device 5 and between the first pressure reducing device 5 and the second heat exchanger 6 and that is provided in parallel with the first pressure reducing device 5. In the refrigerant tank circuit 12, a second pressure reducing device 13, a refrigerant tank 14, and a valve 15 are connected in series in this order from the side close to the first heat exchanger 4. For convenience of explanation, among the circuits forming the refrigeration cycle apparatus 1, the circuit in which, other than the refrigerant tank circuit 12, the compressor 2, the first heat exchanger 4, the first pressure reducing device 5, and the second heat exchanger 6 are connected is sometimes referred to as a main circuit.

The second pressure reducing device 13 reduces the pressure of the high-pressure refrigerant. A device including a valve body the opening degree of which is adjustable, for example, an electronically controlled expansion valve may be used as the second pressure reducing device 13.

The refrigerant tank 14 is a container that stores the refrigerant therein.

The valve 15 has a valve body provided in a pipe forming the refrigerant tank circuit 12 and switches between a refrigerant conduction state and a refrigerant non-conduction state by switching an opened/closed state of the valve body.

[Hardware Configuration]

Figure 3:
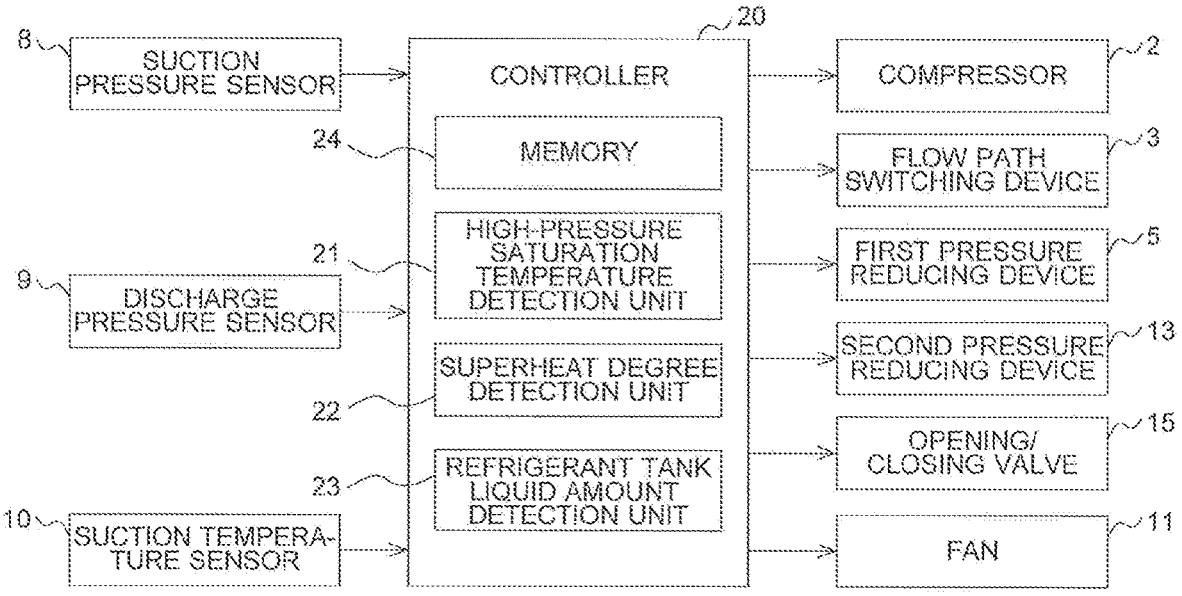
FIG. 3 is a hardware configuration diagram of the refrigeration cycle apparatus according to Embodiment 1.

FIG. 3 is a hardware configuration diagram of the refrigeration cycle apparatus according to Embodiment 1. The refrigeration cycle apparatus 1 includes a controller 20 responsible for controlling the entire refrigeration cycle apparatus 1, and information detected by the suction pressure sensor 8, the discharge pressure sensor 9, and the suction temperature sensor 10 is inputted to the controller 20. The controller 20 is configured to control operation of the compressor 2, the flow path switching device 3, the first pressure reducing device 5, the second pressure reducing device 13, the valve 15, and the fan 11.

The controller 20 has, as functional blocks, a high-pressure saturation temperature detection unit 21, a superheat degree detection unit 22, and a refrigerant tank liquid amount detection unit 23. In addition, the controller 20 has a memory 24.

The high-pressure saturation temperature detection unit 21 detects a high-pressure saturation temperature that is the saturation temperature of the high-pressure refrigerant at the discharge side of the compressor 2, from the pressure of the high-pressure refrigerant detected by the discharge pressure sensor 9 and a conversion table of saturation temperatures under various pressures that is stored in the memory 24.

The superheat degree detection unit 22 detects the saturation temperature of the refrigerant at the suction side from the pressure of the refrigerant at the suction side of the compressor 2 detected by the suction pressure sensor 8 and the conversion table of saturation temperatures under various pressures that is stored in the memory 24. Furthermore, the superheat degree detection unit 22 detects the degree of superheat at the suction portion of the compressor 2 by obtaining the difference between the detected saturation temperature and the temperature of the refrigerant at the suction portion of the compressor 2 detected by the suction temperature sensor 10.

The refrigerant tank liquid amount detection unit 23 detects the liquid amount within the refrigerant tank 14 based on: the degree of superheat at the suction portion of the compressor 2 detected by the superheat degree detection unit 22; and a reference degree of superheat that is generated when the refrigerant tank 14 is filled with liquid and that is stored in the memory 24.

The controller 20 is composed of a CPU (central processing unit, also referred to as a processing unit, an arithmetic unit, a microprocessor, or a processor) that executes a program stored in the memory 24.

In the case where the controller 20 is a CPU, each function performed by the controller 20 is achieved by software, firmware, or a combination of software and firmware. The software or the firmware is described as a program and stored in the memory 24. The CPU achieves each function of the controller 20 by reading and executing a program stored in the memory 24. Here, the memory 24 is a non-volatile or volatile semiconductor memory such as a RAM, a ROM, a flash memory, an EPROM, and an EEPROM.

A part of the high-pressure saturation temperature detection unit 21, the superheat degree detection unit 22, and the refrigerant tank liquid amount detection unit 23 of the controller 20 may be implemented by dedicated hardware, and another part of the high-pressure saturation temperature detection unit 21, the superheat degree detection unit 22, and the refrigerant tank liquid amount detection unit 23 of the controller 20 may be implemented by software or firmware. In the case of implementing the part by hardware, for example, a single circuit, a composite circuit, an ASIC, a FPGA, or a combination thereof is used.

[Cooling Mode]

Flow of the refrigerant in the cooling mode will be described with reference to FIG. 1. The high-temperature and high-pressure refrigerant released from the compressor 2 flows via the flow path switching device 3 into the first heat exchanger 4. At the first heat exchanger 4, the high-temperature and high-pressure refrigerant exchanges heat with air sent from the fan 11 and the temperature of the refrigerant is decreased, and the refrigerant flows out from the first heat exchanger 4. The refrigerant having flowed out from the first heat exchanger 4 is reduced in pressure at the first pressure reducing device 5 to be low-temperature and low-pressure refrigerant, and flows into the second heat exchanger 6. At the second heat exchanger 6, the low-temperature and low-pressure refrigerant exchanges heat with water flowing through the water circuit 16 and the temperature of the refrigerant is increased, and the refrigerant flows out from the second heat exchanger 6. The refrigerant having flowed out from the second heat exchanger 6 flows via the flow path switching device 3 into the accumulator 7 and is separated into gas refrigerant and liquid refrigerant in the accumulator 7. The gas refrigerant in the accumulator 7 is sucked into the compressor 2.

As described above, in the cooling mode, the water flowing through the water circuit 16 is cooled by the refrigerant flowing through the second heat exchanger 6, which is a use side heat exchanger, and the cooled water is used for cooling an indoor space.

The optimum refrigerant amount during rated operation in the cooling mode is larger than the optimum refrigerant amount during rated operation in the heating mode. Thus, in the cooling mode, the refrigerant is not stored in the refrigerant tank 14, and the whole amount of the refrigerant circulates in the refrigeration cycle apparatus 1. In the cooling mode, the second pressure reducing device 13 and the valve 15 are in a state close to full closing or full opening, and the refrigerant does not flow into or out from the refrigerant tank circuit 12.

[Heating Mode]

Flow of the refrigerant in the heating mode will be described with reference to FIG. 2. The high-temperature and high-pressure refrigerant released from the compressor 2 flows via the flow path switching device 3 into the second heat exchanger 6. At the second heat exchanger 6, the high-temperature and high-pressure refrigerant exchanges heat with the water flowing through the water circuit 16 and the temperature of the refrigerant is decreased, and the refrigerant flows out from the second heat exchanger 6. The refrigerant having flowed out from the second heat exchanger 6 is reduced in pressure at the first pressure reducing device 5 to be low-temperature and low-pressure refrigerant, and flows into the first heat exchanger 4. At the first heat exchanger 4, the low-temperature and low-pressure refrigerant exchanges heat with air sent from the fan 11 and the temperature of the refrigerant is increased, and the refrigerant flows out from the first heat exchanger 4. The refrigerant having flowed out from the first heat exchanger 4 flows via the flow path switching device 3 into the accumulator 7, and is separated into gas refrigerant and liquid refrigerant within the accumulator 7. The gas refrigerant within the accumulator 7 is sucked into the compressor 2.

As described above, in the heating mode, the water flowing through the water circuit 16 is heated by the refrigerant flowing through the second heat exchanger 6, which is a use side heat exchanger, and the heated water is used for heating an indoor space.

In the heating mode, the second pressure reducing device 13 is fully closed or in a state close to full closing, and the valve 15 is fully opened. The optimum refrigerant amount during rated operation in the heating mode is smaller than the optimum refrigerant amount during rated operation in the cooling mode. Thus, excessive refrigerant during operation in the heating mode is stored in the refrigerant tank 14, and the amount of the refrigerant circulating through the main circuit in the heating mode is smaller than the amount of the refrigerant circulating through the main circuit in the cooling mode.

In both the above-described cooling mode and heating mode, the controller 20 controls the first pressure reducing device 5 for the degree of superheat. More specifically, the superheat degree detection unit 22 of the controller 20 detects the degree of superheat of the refrigerant at the outlet side of the heat exchanger serving as a condenser, that is, the degree of superheat of the refrigerant at the suction side of the compressor 2, and the controller 20 controls the opening degree of the first pressure reducing device 5 to bring the detected degree of superheat close to a target value.

[Defrost Mode]

During operation in the heating mode, frost may adhere to the outer surface of the pipe of the first heat exchanger 4 serving as an evaporator. Thus, to melt the adhered frost, the refrigeration cycle apparatus 1 operates in a defrost mode. In the defrost mode, similarly to the cooling mode, the flow path switching device 3 connects the discharge side of the compressor 2 to the first heat exchanger 4, the high-temperature refrigerant released from the compressor 2 is caused to flow into the first heat exchanger 4, and the frost is melted by the heat of the refrigerant. In the defrost mode, the low-temperature refrigerant flows into the second heat exchanger 6, which is a use side heat exchanger, and thus the defrost mode is desirably ended in a time that is as short as possible.

Here, since the optimum refrigerant amount in the cooling mode and that in the heating mode are different from each other as described above, the refrigeration cycle apparatus 1 operates, while storing excessive refrigerant in the refrigerant tank 14, in the heating mode. On the other hand, to end the defrost mode in a short time, increasing the ability in the defrost mode is desired. Thus, in Embodiment 1, in the defrost mode, the refrigerant within the refrigerant tank 14 is discharged from the refrigerant tank 14 and circulated, whereby the defrost ability is increased.

Figure 4:
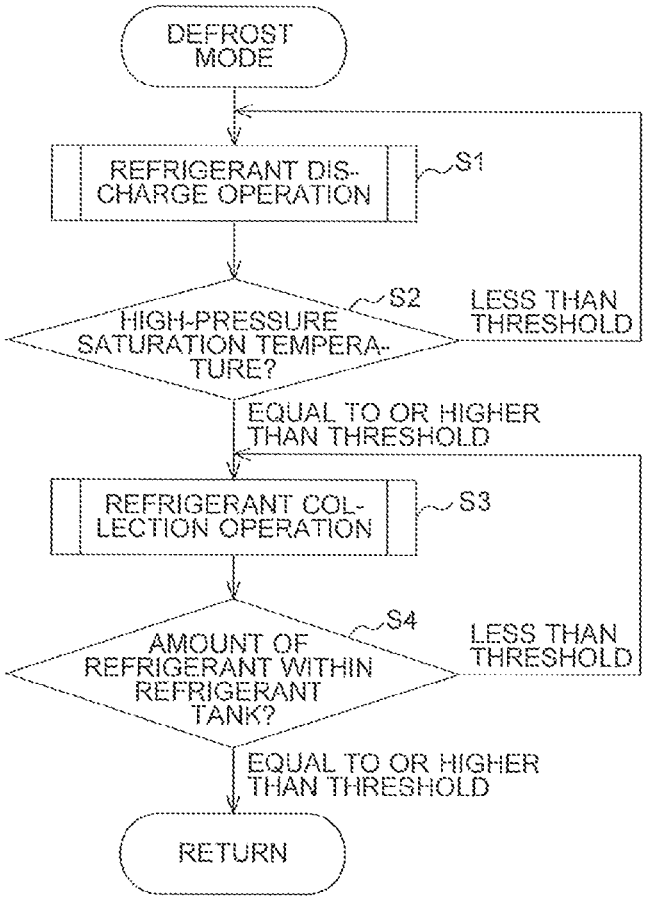
FIG. 4 is a flowchart illustrating flow of a defrost mode according to Embodiment 1.

FIG. 4 is a flowchart illustrating flow of the defrost mode according to Embodiment 1. Flow of the defrost mode according to Embodiment 1 will be roughly described with reference to FIG. 4. When the defrost mode is started, the controller 20 performs a refrigerant release operation of opening either the second pressure reducing device 13 or the valve 15 and discharging the refrigerant within the refrigerant tank 14 (S1). In the refrigerant release operation, the refrigerant released from the compressor 2 is caused to flow to the first heat exchanger 4. When the high-pressure saturation temperature becomes equal to or higher than a threshold (S2), the controller 20 determines that defrosting has been completed, and performs a refrigerant collection operation of opening both the second pressure reducing device 13 and the valve 15 and collecting the refrigerant into the refrigerant tank 14 (S3). When the liquid amount in the refrigerant tank 14 has reached a threshold (S4), the controller 20 ends the defrost mode and returns to the heating mode. Hereinafter, the defrost mode will be further described.

Figure 5:
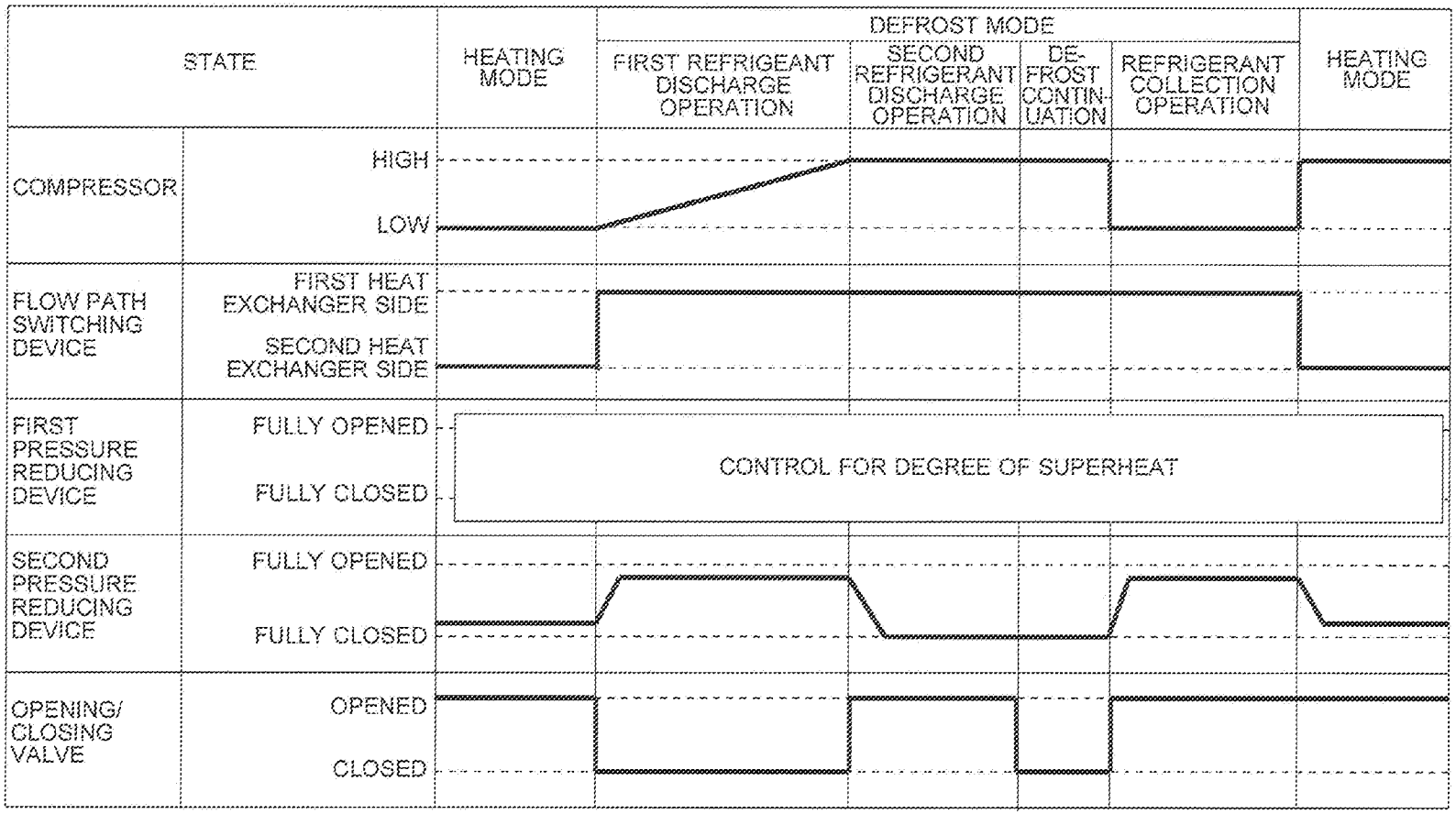
FIG. 5 is a timing chart illustrating operation of actuators in the defrost mode according to Embodiment 1.
Figure 6:
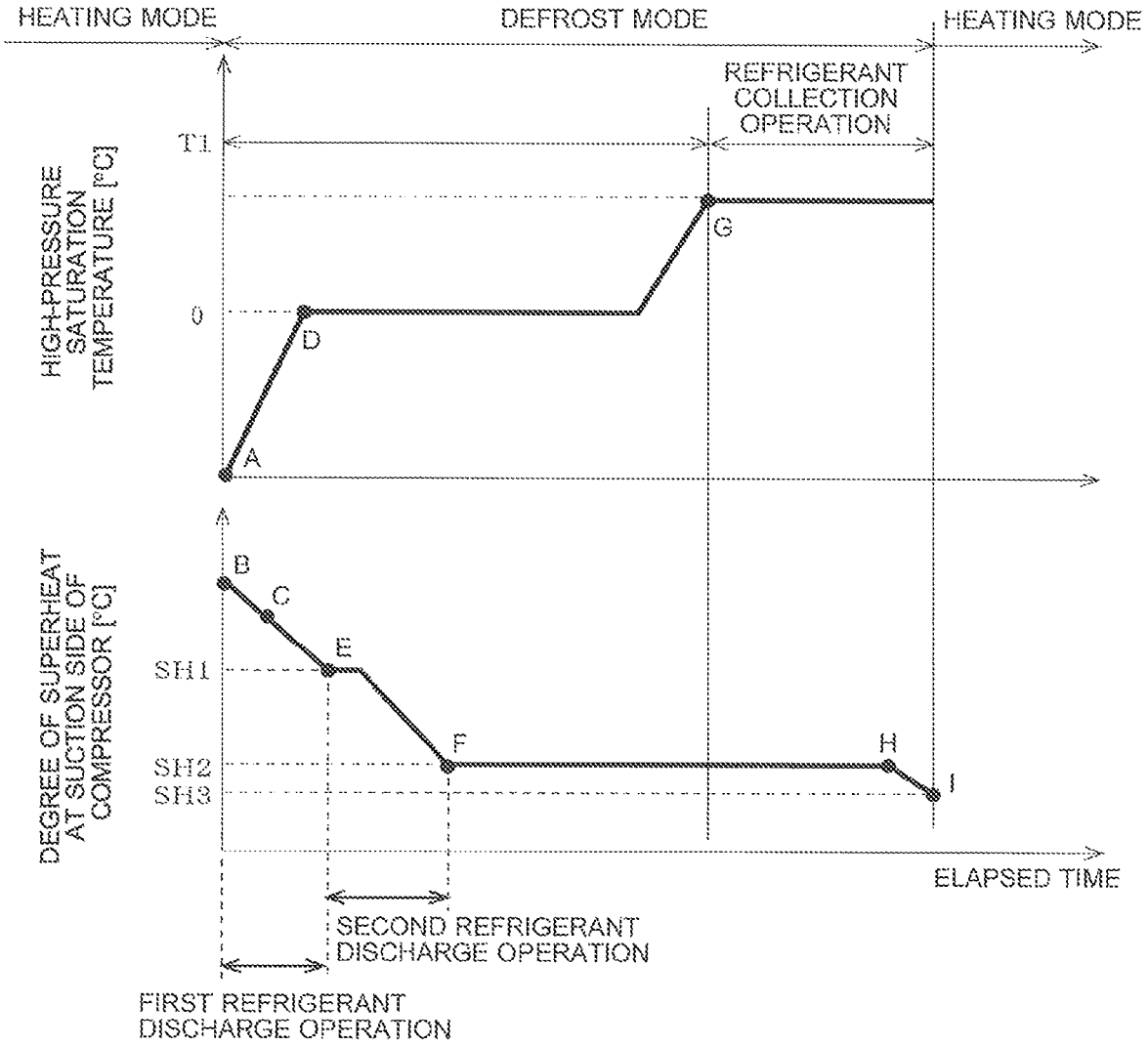
FIG. 6 is a diagram illustrating states of a high-pressure saturation temperature and a degree of superheat at the suction side of a compressor in the defrost mode according to Embodiment 1.
Figure 7:
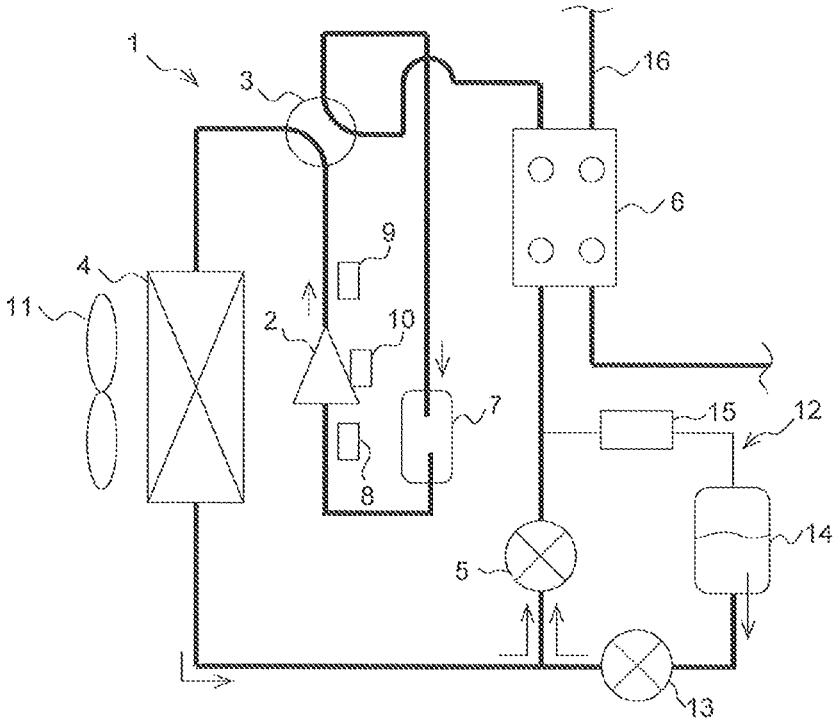
FIG. 7 is a circuit configuration diagram of the refrigeration cycle apparatus according to Embodiment 1 and illustrates a state of a first refrigerant release operation in the defrost mode.
Figure 8:
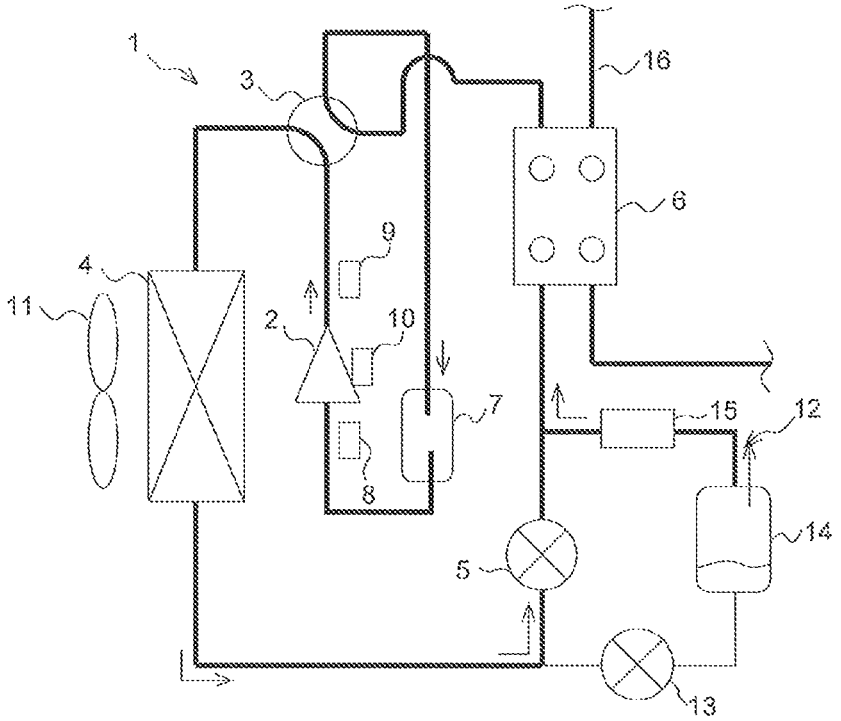
FIG. 8 is a circuit configuration diagram of the refrigeration cycle apparatus according to Embodiment 1 and illustrates a state of a second refrigerant release operation in the defrost mode.
Figure 9:
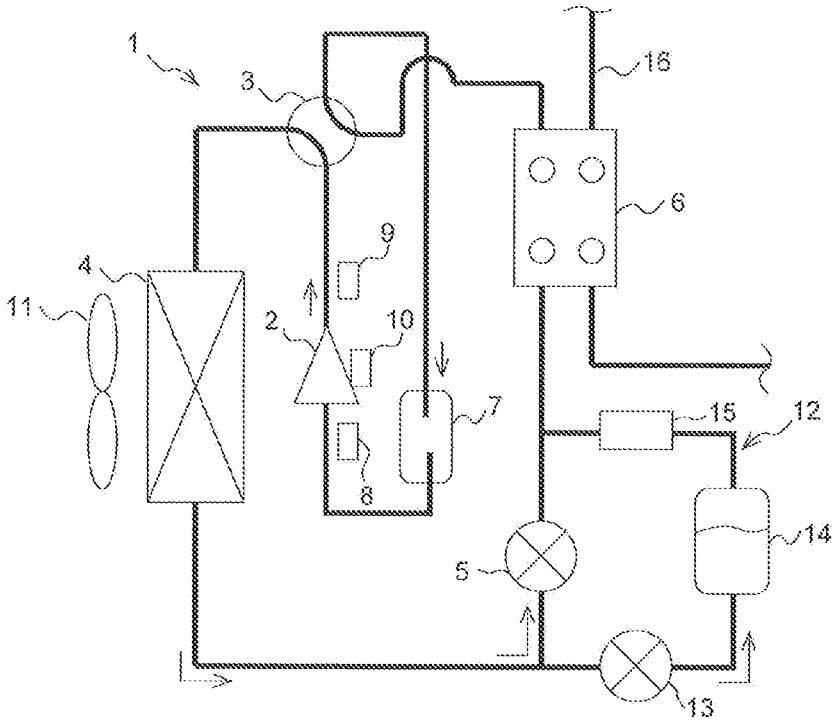
FIG. 9 is a circuit configuration diagram of the refrigeration cycle apparatus according to Embodiment 1 and illustrates a state of a refrigerant collection operation in the defrost mode.

FIG. 5 is a timing chart illustrating operation of actuators in the defrost mode according to Embodiment 1. The state of the "flow path switching device" in FIG. 5 indicates which to connect the discharge portion of the compressor 2 to the first heat exchanger 4 or the second heat exchanger 6. FIG. 6 is a diagram illustrating states of the high-pressure saturation temperature and the degree of superheat at the suction side of the compressor in the defrost mode according to Embodiment 1. The horizontal axis of the graphs in FIG. 6 indicates elapsed time. FIG. 7 is a circuit configuration diagram of the refrigeration cycle apparatus according to Embodiment 1 and illustrates a state of a first refrigerant release operation in the defrost mode. FIG. 8 is a circuit configuration diagram of the refrigeration cycle apparatus according to Embodiment 1 and illustrates a state of a second refrigerant release operation in the defrost mode. FIG. 9 is a circuit configuration diagram of the refrigeration cycle apparatus according to Embodiment 1 and illustrates a state of the refrigerant collection operation in the defrost mode. Operation of the defrost mode according to Embodiment 1 will be described along FIG. 5 with appropriate reference to FIGS. 6 to 9.

As shown in FIG. 5, in the heating mode, the compressor 2 operates with a capacity determined based on an air-conditioning load, the flow path switching device 3 connects the discharge side of the compressor 2 to the first heat exchanger 4, and the opening degree of the first pressure reducing device 5 is controlled for the degree of superheat. The second pressure reducing device 13 of the refrigerant tank circuit 12 is fully closed or in a state close to full closing, and the valve 15 is in an opened state. The second pressure reducing device 13 and the valve 15 only need to be in a state that allows the refrigerant tank 14 to be kept filled with liquid in the heating mode, and are not limited to the example of FIG. 5. In the heating mode, the refrigeration cycle apparatus 1 is as shown in FIG. 2.

[Defrost Mode—First Refrigerant Discharge Operation]

When the defrost mode is started, the first refrigerant release operation is initially performed. In the first refrigerant release operation, the flow path switching device 3 connects the discharge side of the compressor 2 to the second heat exchanger 6, the second pressure reducing device 13 is controlled to be in an opened state, and the valve 15 is controlled to be in a closed state. The opening degree of the second pressure reducing device 13 may be full opening or may be an opening degree slightly lower than full opening for inhibiting liquid backflow to the compressor 2. The first pressure reducing device 5 is controlled for the degree of superheat also during the defrost mode. The operation capacity of the compressor 2 is increased for enhancing the defrost ability in the example of FIG. 5, and control of the compressor 2 for the ability is not limited in the present invention.

As shown at a point A in FIG. 6, when the first refrigerant release operation is started, the high pressure and the low pressure are inverted with flow path switching of the flow path switching device 3, and thus the high-pressure saturation temperature is low. The low-pressure saturation temperature also decreases with a decrease in the high-pressure saturation temperature, but a low pressure difference state is obtained since the temperature of the water in the water circuit 16 flowing through the second heat exchanger 6 is high due to the effect of the heating mode before start of the defrost mode. Thus, as shown at a point B, the degree of superheat at the suction portion of the compressor 2 is high.

As shown in FIG. 7, the refrigerant tank 14 is connected to the high-pressure side of the main circuit by closing the valve 15 of the refrigerant tank circuit 12 and opening the second pressure reducing device 13. In the main circuit, since this time is immediately after the low pressure and the high pressure are inverted, and the interior of the refrigerant tank 14 that has been connected to the high-pressure side in the heating mode until just before is in a relatively high pressure state, the liquid refrigerant is discharged from the refrigerant tank 14. Accordingly, as shown at a point C in FIG. 6, the degree of superheat at the suction side of the compressor 2 rapidly decreases. In addition, as shown at a point D in FIG. 6, with progress of the first refrigerant release operation, the high-pressure saturation temperature rises to the melting temperature (0 degrees C.) of frost. The defrost ability increases by circulating the refrigerant stored in the refrigerant tank 14 through the main circuit.

When, as shown at a point E in FIG. 6, the degree of superheat at the suction side of the compressor 2 decreases to a threshold SH1 that is a liquid discharge end determination threshold, the controller 20 determines that the discharge of the refrigerant within the refrigerant tank 14 has been completed, and ends the first refrigerant release operation. As shown in FIG. 5, when the first refrigerant release operation is ended, the second pressure reducing device 13 is made into a closed state.

[Defrost Mode—Second Refrigerant Discharge Operation]

Here, since the refrigerant tank 14 discharges the refrigerant to the high-pressure side of the main circuit in the first refrigerant release operation as described above, liquid backflow is inhibited as compared to the case where the refrigerant is discharged to the low-pressure side of the main circuit. However, when the pressure within the refrigerant tank 14 and the pressure at the high-pressure side are equalized, the refrigerant may remain within the refrigerant tank 14. Thus, to further enhance the defrost ability, the second refrigerant release operation for discharging the refrigerant remaining within the refrigerant tank 14 is executed.

As shown in FIG. 5, in the second refrigerant release operation, the second pressure reducing device 13 is controlled to be in a closed state, and the valve 15 is controlled to be in an opened state. In the example of FIG. 5, the compressor 2 is maintained in a state where the operation capacity thereof is high. However, in the present invention, control of the ability of the compressor 2 is not limited. In addition, the first pressure reducing device 5 continues to be controlled for the degree of superheat.

As shown in FIG. 8, the refrigerant tank 14 is connected to the low-pressure side of the main circuit by opening the valve 15 of the refrigerant tank circuit 12 and closing the second pressure reducing device 13. The refrigerant remaining within the refrigerant tank 14 is discharged due to the pressure difference between the interior of the refrigerant tank 14 and the downstream side of the valve 15 (the downstream side of the first pressure reducing device 5).

As shown in FIG. 6, when the second refrigerant release operation is started, the refrigerant remaining within the refrigerant tank 14 is discharged, so that the degree of superheat at the suction side of the compressor 2 decreases. Then, when, as shown at a point F in FIG. 6, the degree of superheat at the suction side of the compressor 2 decreases to a threshold SH2 that is a liquid discharge end determination threshold, the controller 20 determines that the discharge of the refrigerant within the refrigerant tank 14 has been completed, and ends the second refrigerant release operation. When the second refrigerant release operation is ended, the valve 15 is made into a closed state.

[Defrost Mode—Defrost Continuation Operation]

When the discharge of the refrigerant from the refrigerant tank 14 ends, a defrost continuation operation is executed. As shown in FIG. 5, in the defrost continuation operation, the second pressure reducing device 13 and the valve 15 are controlled to be in a closed state. The compressor 2 and the first pressure reducing device 5 continue to be controlled in the same manner as before.

Due to operation in the defrost mode, melting of frost adhering to the first heat exchanger 4 proceeds, and the high-pressure saturation temperature rises as shown in FIG. 6. Then, as shown at a point G in FIG. 6, when the high-pressure saturation temperature has reached a threshold T1 that is a defrost end determination threshold, the controller 20 determines that defrosting has been completed, and ends the defrost continuation operation.

[Defrost Mode—Refrigerant Collection Operation]

In the defrost mode, the refrigerant within the refrigerant tank 14 is circulated to improve the defrost ability. In returning to the heating mode, the refrigerant collection operation of collecting, in the refrigerant tank 14, the refrigerant that is to be excessive in the heating mode is performed.

As shown in FIG. 5, in the refrigerant collection operation, the second pressure reducing device 13 and the valve 15 are controlled to be in an opened state. The flow path switching device 3 is maintained in a state of connecting the discharge side of the compressor 2 to the second heat exchanger 6. The first pressure reducing device 5 continues to be controlled for the degree of superheat. The operation capacity of the compressor 2 is relatively decreased.

As shown in FIG. 9, since the second pressure reducing device 13 and the valve 15 of the refrigerant tank circuit 12 are opened, the refrigerant flowing from the first heat exchanger 4 is branched at the upstream side of the first pressure reducing device 5, is reduced in pressure at the second pressure reducing device 13 to be liquid refrigerant, and accumulates within the refrigerant tank 14. Of the refrigerant to be circulated, mainly gas refrigerant flows out from the refrigerant tank 14 and flows via the valve 15 toward the second heat exchanger 6. In Embodiment 1, in the refrigerant collection operation, the operation ability of the compressor 2 is decreased, so that the circulation speed of the refrigerant decreases and the refrigerant easily accumulates within in the refrigerant tank 14.

When the refrigerant tank 14 becomes filled with liquid by the refrigerant collection operation, the liquid refrigerant flows into the downstream side of the second heat exchanger 6, and the degree of superheat at the suction side of the compressor 2 starts to decrease as shown at a point H in FIG. 6. When the degree of superheat at the suction side of the compressor 2 decreases to a threshold SH3, which is a collection end determination threshold, as shown at a point I in FIG. 6 by using this phenomenon, the controller 20 determines that the refrigerant tank 14 has become filled with liquid, and ends the refrigerant collection operation.

FIG. 5 shows an example in which the defrost continuation operation is performed between the refrigerant release operation and the refrigerant collection operation. Depending on the amount of frost formed in the first heat exchanger 4, all the frost may be melted during the refrigerant release operation. Therefore, when it is detected that the high-pressure saturation temperature has reached T1, which is the defrost end determination threshold, during the refrigerant release operation, the controller 20 stops the refrigerant release operation and shifts to the refrigerant collection operation.

[Restart of Heating Mode]

As shown in FIG. 5, when the defrost mode is ended, the heating mode is restarted. Specifically, the ability of the compressor 2 is controlled in accordance with a required load. Since the second heat exchanger 6, which is a use side heat exchanger, is cooled in the defrost mode, when the heating mode is restarted, the compressor 2 is generally operated in a state where the operation ability thereof is high. The flow path switching device 3 connects the discharge side of the compressor 2 to the second heat exchanger 6. The first pressure reducing device 5 continues to be controlled for the degree of superheat. The opening degree of the second pressure reducing device 13 of the refrigerant tank circuit 12 is in a state close to full closing or full opening, and the valve 15 is in an opened state.

As described above, according to Embodiment 1, since the refrigerant within the refrigerant tank 14 is discharged in the defrost mode, the amount of the refrigerant circulating within the main circuit increases, whereby it is possible to increase the defrost ability. By increasing the defrost ability, it is possible to shorten the time of the defrost operation.

According to Embodiment 1, in returning from the defrost mode to the heating mode, the refrigerant is collected within the refrigerant tank 14, and then the heating mode is started. By decreasing the amount of the refrigerant circulating within the main circuit in starting the heating mode, it is possible to inhibit liquid backflow. Therefore, even when the accumulator 7 is downsized, it is possible to avoid breakdown due to liquid backflow to the compressor 2. The configuration example in which the accumulator 7 is provided has been described in Embodiment 1. However, according to Embodiment 1, liquid backflow to the downstream side of the evaporator is inhibited as described above, and thus the accumulator 7 may not be provided.

According to Embodiment 1, since the refrigerant tank circuit 12 is connected in parallel with the first pressure reducing device 5, the refrigerant that is to be excessive in the heating mode is stored within the refrigerant tank 14 and prevented from circulating within the main circuit of the refrigeration cycle apparatus 1. Accordingly, it is possible to inhibit liquid backflow to the downstream side of the first heat exchanger 4, which serves as an evaporator in the heating mode. Therefore, the accumulator 7 may not be provided, or even when the accumulator 7 is provided, it is possible to reduce the size of the accumulator 7. As a result, it is possible to downsize the machine chamber of the refrigeration cycle apparatus 1 in which the accumulator 7 is generally provided, and the space for the refrigeration cycle apparatus 1 is saved.

Embodiment 2

The example in which both the first refrigerant release operation and the second refrigerant release operation are performed in the defrost mode, has been described in Embodiment 1. In Embodiment 2, an example in which only the first refrigerant release operation is performed will be described. In Embodiment 2, the configuration of the refrigeration cycle apparatus 1 is the same as in Embodiment 1, and only operation in the defrost mode is different from that in Embodiment 1. Thus, the difference from Embodiment 1 will be mainly described.

Figure 10:
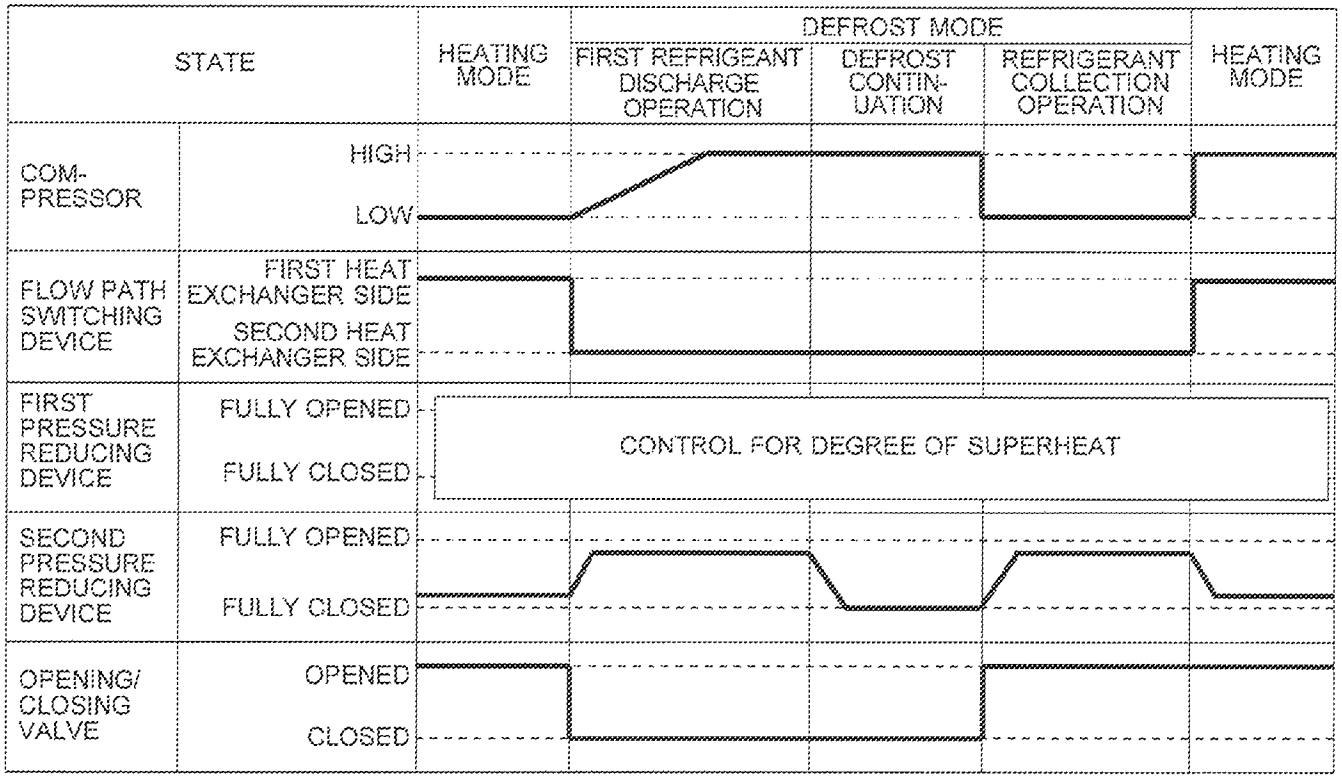
FIG. 10 is a timing chart illustrating operation of actuators in a defrost mode according to Embodiment 2.

FIG. 10 is a timing chart illustrating operation of the actuators in the defrost mode according to Embodiment 2. The state of the "flow path switching device" in FIG. 10 indicates which to connect the discharge side of the compressor 2 to the first heat exchanger 4 or the second heat exchanger 6. As shown in FIG. 10, in the defrost mode of Embodiment 2, only the first refrigerant release operation is performed. Specifically, when switching is made from the heating mode to the defrost mode, the second pressure reducing device 13 is made into an opened state, and the valve 15 is made into a closed state. In this manner, as shown in FIG. 7, the refrigerant tank 14 is connected to the high-pressure side of the main circuit, the refrigerant within the refrigerant tank 14 is discharged, and the amount of the refrigerant circulating in the refrigeration cycle apparatus 1 is increased. By increasing the amount of the refrigerant circulating, it is possible to enhance the defrost ability in the defrost mode.

Embodiment 3

The example in which both the first refrigerant release operation and the second refrigerant release operation are performed in the defrost mode, has been described in Embodiment 1. In Embodiment 3, an example in which only the second refrigerant release operation is performed will be described. In Embodiment 3, the configuration of the refrigeration cycle apparatus 1 is the same as in Embodiment 1, and only operation in the defrost mode is different from that in Embodiment 1. Thus, the difference from Embodiment 1 will be mainly described.

Figure 11:
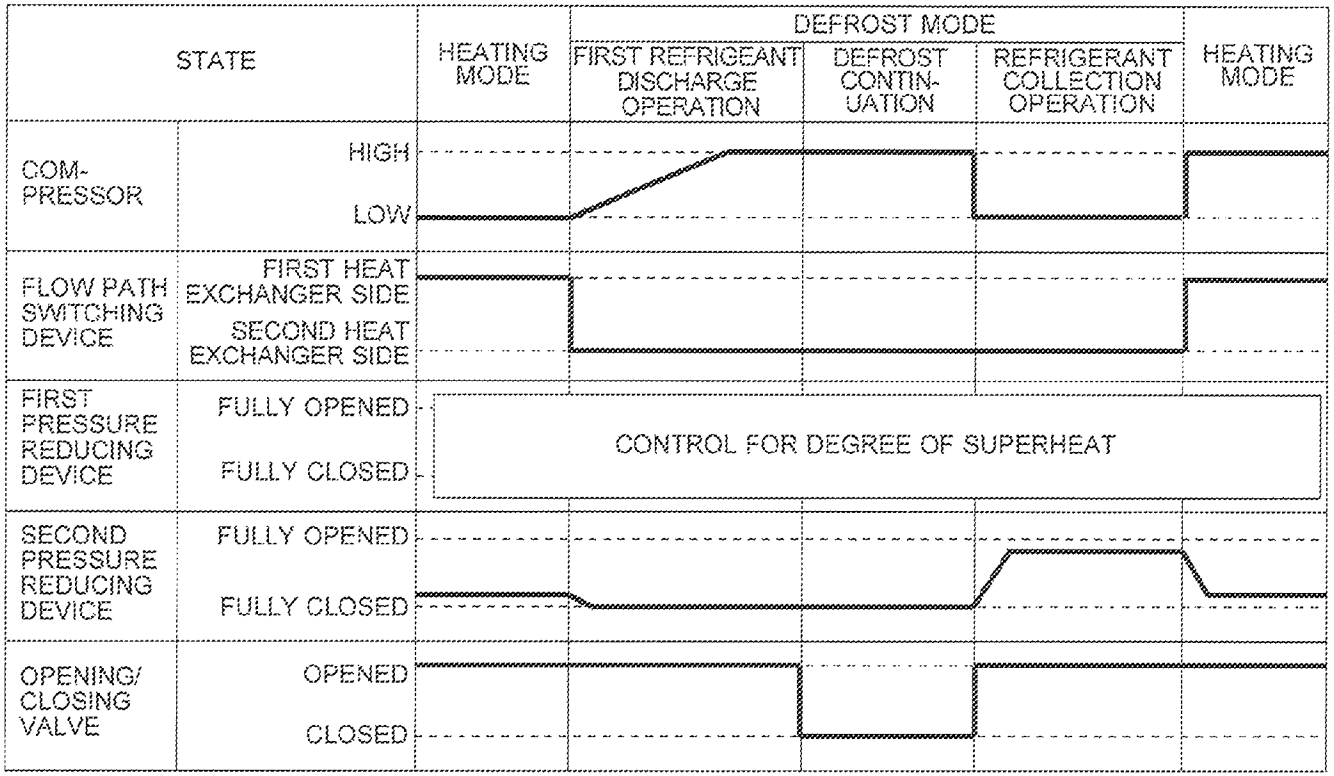
FIG. 11 is a timing chart illustrating operation of actuators in a defrost mode according to Embodiment 3.

FIG. 11 is a timing chart illustrating operation of the actuators in the defrost mode according to Embodiment 3. The state of the "flow path switching device" in FIG. 11 indicates which to connect the discharge side of the compressor 2 to the first heat exchanger 4 or the second heat exchanger 6. As shown in FIG. 11, in the defrost mode of Embodiment 3, only the second refrigerant release operation is performed. Specifically, when switching is made from the heating mode to the defrost mode, the second pressure reducing device 13 is made into a closed state, and the valve 15 is made into an opened state. In this manner, as shown in FIG. 8, the refrigerant tank 14 is connected to the low-pressure side of the main circuit, the refrigerant within the refrigerant tank 14 is discharged, and the amount of the refrigerant circulating in the refrigeration cycle apparatus 1 is increased. By increasing the amount of the refrigerant circulating, it is possible to enhance the defrost ability in the defrost mode.

[Modifications]

Modifications of the configuration and control of the refrigeration cycle apparatus 1 described in Embodiments 1 to 3 will be described below.

(1) Example of Refrigerant Tank Liquid Amount Detection

As means for detecting the amount of the liquid refrigerant within the refrigerant tank 14, there is the following means other than means for detecting the amount of the liquid refrigerant based on the degree of superheat at the suction side of the compressor 2.

Figure 12:
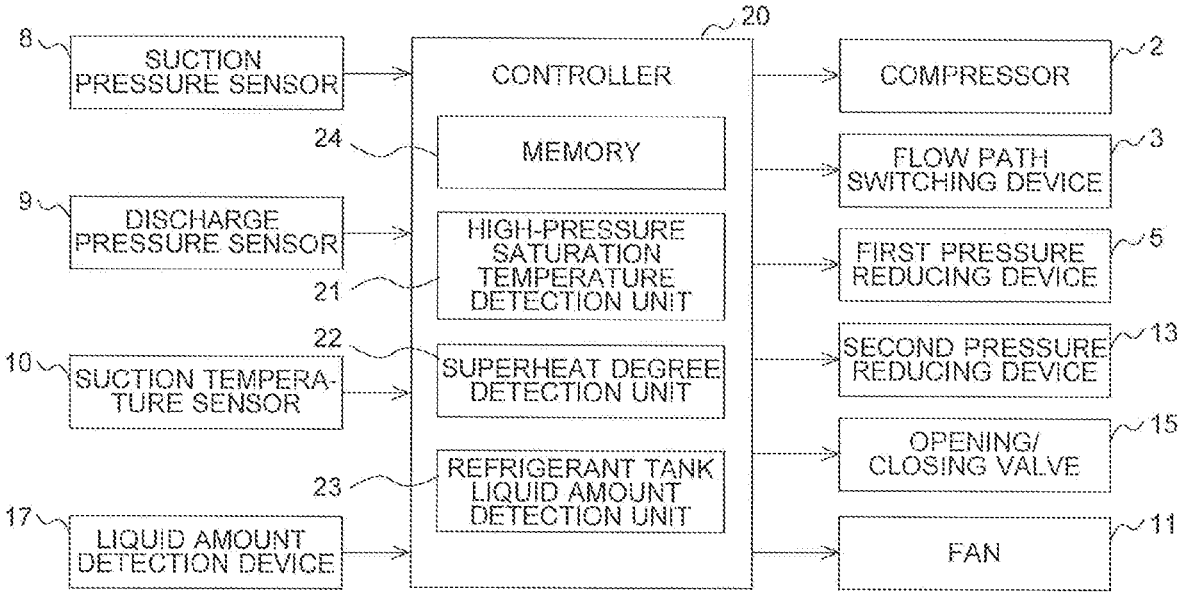
FIG. 12 is a hardware configuration diagram of a refrigeration cycle apparatus according to a modification of Embodiments 1 to 3.

FIG. 12 is a hardware configuration diagram of a refrigeration cycle apparatus according to a modification of Embodiments 1 to 3. The refrigeration cycle apparatus according to the modification includes a liquid amount detection device 17, and the refrigerant tank liquid amount detection unit 23 of the controller 20 detects the amount of the liquid refrigerant within the refrigerant tank 14 based on information inputted from the liquid amount detection device 17.

(1-1) Timer

An example of the liquid amount detection device 17 is a timer. The refrigerant tank liquid amount detection unit 23 counts an elapsed time of the refrigerant collection operation (either one of or both a first refrigerant collection operation and a second refrigerant collection operation) based on a counted time inputted from the liquid amount detection device 17, which is the timer. When the elapsed time of the refrigerant collection operation has reached a threshold, the refrigerant tank liquid amount detection unit 23 determined that the interior of the refrigerant tank 14 has been filled with liquid. The threshold for the elapsed time of the refrigerant collection operation may be obtained through an experiment or the like in advance.

Figure 13:
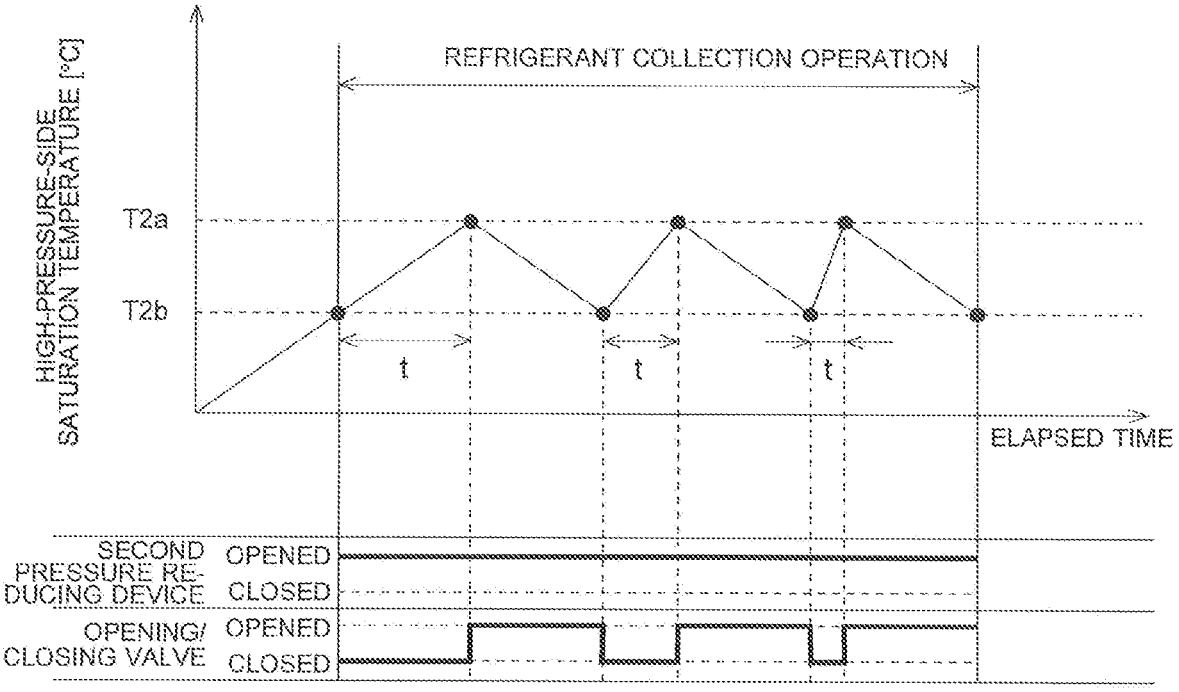
FIG. 13 is a diagram illustrating a refrigerant collection operation of a refrigerant tank according to a modification of Embodiments 1 to 3.

Alternatively, a timer may be used as the liquid amount detection device 17, and the amount of the liquid refrigerant within the refrigerant tank 14 may be further detected based on the high-pressure saturation temperature. FIG. 13 is a diagram illustrating a refrigerant collection operation for a refrigerant tank according to a modification of Embodiments 1 to 3. In FIG. 13, the vertical axis indicates the high-pressure saturation temperature, and the horizontal axis indicates the elapsed time. In the refrigerant collection operation, the controller 20 temporarily closes the valve 15 with the second pressure reducing device 13 being opened. Accordingly, the refrigerant accumulates within the refrigerant tank 14 since the second pressure reducing device 13 is opened, but the gas refrigerant within the refrigerant tank 14 is not discharged since the valve 15 is closed. Thus, when a certain amount of the refrigerant has accumulated within the refrigerant tank 14, the refrigerant does not further enter the refrigerant tank 14, and the high-pressure saturation temperature rises. When the high-pressure saturation temperature rises to a threshold T2*a*, the controller 20 opens the valve 15. When the valve 15 opens, the gas refrigerant within the refrigerant tank 14 is discharged, the refrigerant accumulates within the refrigerant tank 14, and the high-pressure saturation temperature falls with collection of the liquid refrigerant within the refrigerant tank 14. When the high-pressure saturation temperature falls to a threshold T2*b*, the controller 20 closes the valve 15 again. As described above, the controller 20 repeatedly switches between opening and closing of the valve 15 based on the high-pressure saturation temperature.

Here, as the refrigerant is accumulated in the refrigerant tank 14 while opening and closing of the valve 15 are switched as described above, the liquid level within the refrigerant tank 14 gradually rises. Accordingly, a time t taken for the high-pressure saturation temperature to rise from the threshold T2*b* to the threshold T2*a* becomes shorter as the time of the refrigerant collection operation elapses. On the basis of the time inputted from the liquid amount detection device 17, which is the timer, the refrigerant tank liquid amount detection unit 23 counts the time t taken for the high-pressure saturation temperature to rise from the threshold T2*b* to the threshold T2*a* in a state where the valve 15 is closed. Then, when the time t decreases to a threshold, the refrigerant tank liquid amount detection unit 23 determines that the refrigerant tank 14 has been filled with liquid. As described above, by detecting the amount of the liquid in the refrigerant tank 14 while switching the opened/closed state of the valve 15, it is possible to perform the refrigerant collection operation while enhancing the effect of inhibiting liquid backflow. In the example of FIG. 13, the refrigerant collection operation is started in a state where the valve 15 is closed, but the refrigerant collection operation may be started in a state where the valve 15 is opened, and then the opened/closed state of the valve 15 may be switched.

(1-2) Liquid Level Sensor

Another example of the liquid amount detection device 17 is a liquid level sensor that detects a liquid surface level. A specific example of the liquid level sensor is a float sensor that is provided within the refrigerant tank 14 and that detects the liquid surface of the liquid refrigerant within the refrigerant tank 14. Another specific example of the liquid level detection sensor is an ultrasonic sensor that includes: an oscillator for emitting an ultrasonic wave and a reception unit for receiving the emitted ultrasonic wave and that detects the liquid surface of the liquid refrigerant within the refrigerant tank 14 based on the time from the emission of the ultrasonic wave to the reception thereof. Still another example of the liquid level sensor is a plurality of temperature sensors such as thermal resistance detectors provided at a side surface of the refrigerant tank 14 in the height direction, and detects the liquid surface based on the difference between detection values of the plurality of temperature sensors. The specific examples of the liquid level sensor are not limited to those described here.

(1-3) Sound Collection Sensor

Another example of the liquid amount detection device 17 is a sound collection sensor provided to the valve 15. The refrigerant tank liquid amount detection unit 23 determines whether the interior of the refrigerant tank 14 is filled with liquid, based on a noise value (dB) inputted from the liquid amount detection device 17, which is the sound collection sensor. Specifically, at the time when the refrigerant collection operation is started, almost no liquid refrigerant has been stored within the refrigerant tank 14, and thus the refrigerant passing through the valve 15 is gas refrigerant. With elapse of time of the refrigerant collection operation, the liquid refrigerant accumulates within the refrigerant tank 14 and the refrigerant tank 14 becomes filled with liquid, the liquid refrigerant flowing out from the refrigerant tank 14 passes through the valve 15. Here, the noise value (dB) obtained when the gas refrigerant passes through the valve 15 is different from that when the liquid refrigerant passes through the valve 15, and the noise value (dB) obtained when the liquid refrigerant passes through the valve 15 is lower. Therefore, the refrigerant tank liquid amount detection unit 23 is able to determine that the refrigerant tank 14 has become filled with liquid, when the noise value (dB) inputted from the liquid amount detection device 17, which is the sound collection sensor, decreases to a threshold.

(2) Example of Valve 15

A specific example of the valve 15 is a bidirectional solenoid valve that is provided on a pipe between the first pressure reducing device 5 and the second heat exchanger 6 and on a pipe connecting the first pressure reducing device 5 and an upper portion of the refrigerant tank 14. Another specific example of the valve 15 is an electronically controlled expansion valve that is provided on the pipe between the first pressure reducing device 5 and the second heat exchanger 6 and on the pipe connecting the first pressure reducing device 5 and the upper portion of the refrigerant tank 14 and the opening degree of which is adjustable. Still another specific example of the valve 15 is a valve unit having a one-way solenoid valve and a check valve provided on the pipe between the first pressure reducing device 5 and the second heat exchanger 6 and on the pipe connecting the first pressure reducing device 5 and the upper portion of the refrigerant tank 14.

(3) Example of Refrigerant Tank 14

Figure 14A:
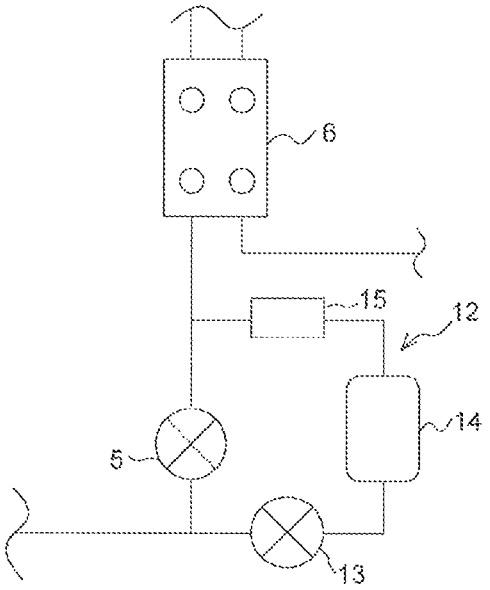
FIG. 14A is a diagram illustrating a configuration example 1 of the refrigerant tank according to the modification of Embodiments 1 to 3.
Figure 14B:
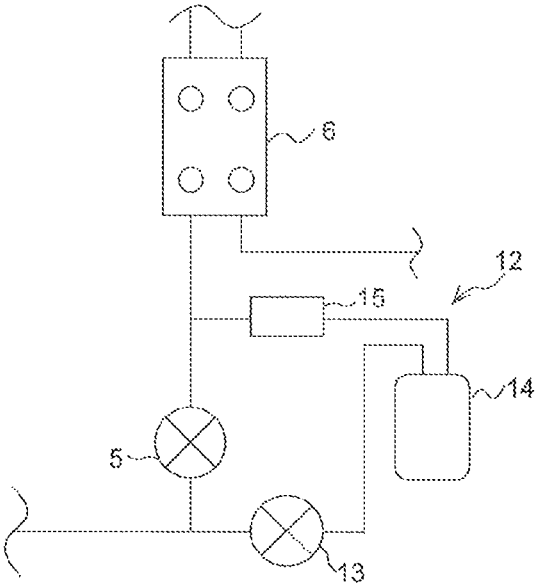
FIG. 14B is a diagram illustrating a configuration example 2 of the refrigerant tank according to the modification of Embodiments 1 to 3.
Figure 14C:
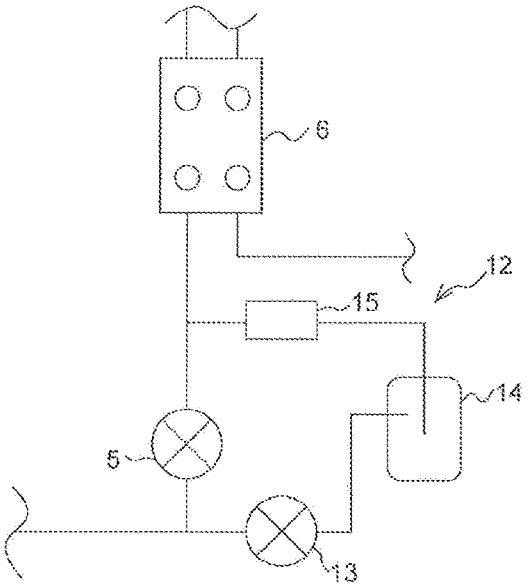
FIG. 14C is a diagram illustrating a configuration example 3 of the refrigerant tank according to the modification of Embodiments 1 to 3.

FIGS. 14A to 14C are diagrams illustrating configuration examples of a refrigerant tank according to modifications of Embodiments 1 to 3. In the example shown in FIG. 14A, a lower portion of the refrigerant tank 14 and the second pressure reducing device 13 are connected to each other by a first pipe, and the upper portion of the refrigerant tank 14 and the valve 15 are connected to each other by a second pipe.

In the example shown in FIG. 14B, a first pipe and a second pipe are provided to the upper portion of the refrigerant tank 14, the first pipe is connected to the second pressure reducing device 13, and the second pipe is connected to the valve 15. This configuration example has a function to separate the refrigerant flowing into the refrigerant tank 14 from the second pipe provided to the upper portion of the refrigerant tank 14, into gas refrigerant and liquid refrigerant by using gravity.

In the example shown in FIG. 14C, a first pipe inserted through a side surface of the refrigerant tank 14 is connected to the second pressure reducing device 13, and a second pipe inserted through the upper portion of the refrigerant tank 14 into the refrigerant tank 14 is connected to the valve 15. The inner surface of the refrigerant tank 14 is cylindrical or tapered. In this configuration example, the refrigerant flowing from the first pipe, which is inserted through the side surface of the refrigerant tank 14 into the refrigerant tank 14, is whirled along the inner surface of the refrigerant tank 14 to be separated into gas refrigerant and liquid refrigerant, and the gas refrigerant is emitted through the second pipe inserted to a center portion in a whirl flow generated within the refrigerant tank 14.

(4) Example of Second Heat Exchanger

The second heat exchanger 6 shown in Embodiments 1 to 3 is a refrigerant-water heat exchanger that exchanges heat between the refrigerant within the refrigeration cycle apparatus 1 and the water within the water circuit 16. As another example of the second heat exchanger 6, a refrigerant-refrigerant heat exchanger that exchanges heat between the refrigerant within the refrigeration cycle apparatus 1 and refrigerant in another refrigeration cycle apparatus. In addition, as still another example of the second heat exchanger 6, a refrigerant-air heat exchanger that exchanges heat between air and the refrigerant within the refrigeration cycle apparatus 1.

(5) System Including Refrigeration Cycle Apparatuses of Multiple Systems

Figure 15:
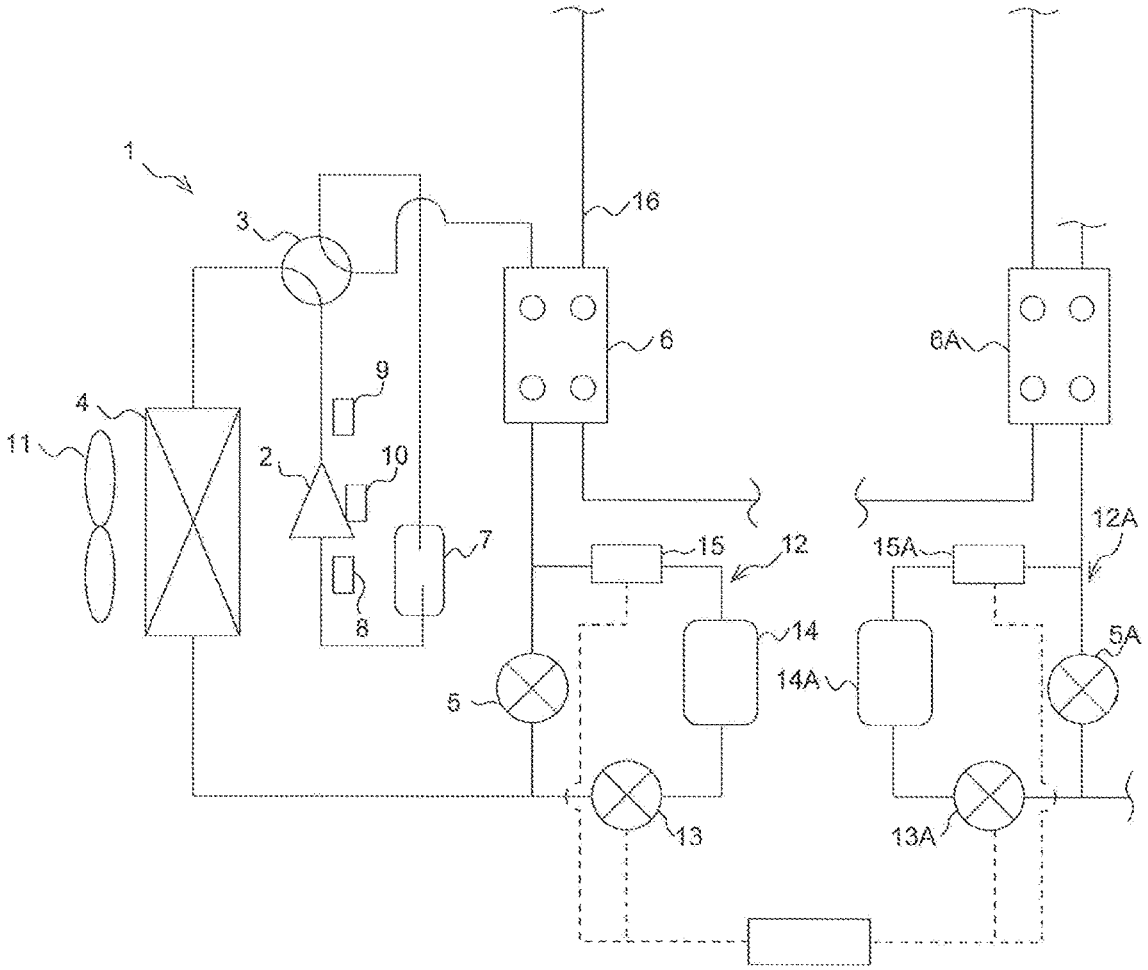
FIG. 15 is a circuit configuration diagram of a refrigeration cycle apparatus according to a modification of Embodiments 1 to 3.

FIG. 15 is a circuit configuration diagram of a refrigeration cycle apparatus according to a modification of Embodiments 1 to 3. FIG. 15 shows a configuration example of a system including refrigeration cycle apparatuses of multiple systems, and the configurations of a refrigeration cycle apparatus of a different system are denoted by adding an index A. In the system provided with the refrigeration cycle apparatuses of the multiple systems, it is possible to synchronously control the second pressure reducing devices 13 and 13A provided in the refrigerant tank circuits 12 and 12A, by the same controller 20 having a shared control board. In addition, it is also possible to synchronously control the valves 15 and 15A by the controller 20 having the shared control board. By sharing the control board with a plurality of the second pressure reducing devices 13 and 13A or a plurality of the valves 15 and 15A, it is possible to reduce the number of ports in the control board.

These modifications may be used in combination with Embodiments 1 to 3, and the modifications may be combined and used as appropriate without impairing functions thereof.

As described above, the refrigeration cycle apparatus 1 according to Embodiments 1 to 3 includes: the compressor 2; the first heat exchanger 4; the second heat exchanger 6 connected in series with the first heat exchanger 4 and having a capacity smaller than the first heat exchanger 4; the first pressure reducing device 5 connected between the first heat exchanger 4 and the second heat exchanger 6; the flow path switching device 3 configured to form the first flow path through which the refrigerant released from the compressor 2 flows to the first heat exchanger 4 in the cooling mode and the defrost mode, and form the second flow path through which the refrigerant released from the compressor 2 flows to the second heat exchanger 6 in the heating mode; the refrigerant tank circuit 12 branching from between the first heat exchanger 4 and the first pressure reducing device 5 and joining between the first pressure reducing device 5 and the second heat exchanger 6, being in parallel with the first pressure reducing device 5, and in which the second pressure reducing device 13, the refrigerant tank 14, and the valve 15 opening and closing the flow path between the refrigerant tank 14 and the second heat exchanger 6 are connected in series; and the controller 20 configured to control the flow path switching device 3, the second pressure reducing device 13, and the valve 15. The first pressure reducing device 5 is configured to, when the defrost mode is started, adjust the flow rate of the refrigerant to bring the degree of superheat of the refrigerant at the suction side of the compressor 2 close to the target value. The controller 20 is configured to, when the defrost mode is started: control the flow path switching device 3 to form the first flow path; perform the refrigerant release operation of opening one of the second pressure reducing device 13 and the valve 15 and closing the other of the second pressure reducing device 13 and the valve 15; and perform the refrigerant collection operation of opening the second pressure reducing device 13 and the valve 15, with the flow path switching device retained to form the first flow path, after the refrigerant release operation.

As illustrated in Embodiment 2, the controller 20 may be configured to, in the refrigerant release operation, open the second pressure reducing device 13, close the valve 15, and cause the refrigerant within the refrigerant tank 14 to flow in between the first heat exchanger 4 and the first pressure reducing device 5.

As illustrated in Embodiment 3, the controller 20 may be configured to, in the refrigerant release operation, close the second pressure reducing device 13, open the valve 15, and cause the refrigerant within the refrigerant tank 14 to flow, via the valve 15, in between the first pressure reducing device 5 and the second heat exchanger 6.

As illustrated in Embodiment 1, the controller 20 may be configured to, in the refrigerant release operation: open the second pressure reducing device 13, close the valve 15, and cause the refrigerant within the refrigerant tank 14 flow in between the first heat exchanger 4 and the first pressure reducing device 5; and then close the second pressure reducing device 13, open the valve 15, and cause the refrigerant within the refrigerant tank 14 to flow, via the valve 15, in between the first pressure reducing device 5 and the second heat exchanger 6.

The controller 20 may be configured to, in the refrigerant release operation: close the second pressure reducing device 13, open the valve 15, and cause the refrigerant within the refrigerant tank 14 to flow, via the valve 15, in between the first pressure reducing device 5 and the second heat exchanger 6; and then open the second pressure reducing device 13, close the valve 15, and cause the refrigerant within the refrigerant tank 14 to flow in between the first heat exchanger 4 and the first pressure reducing device 5.

According to this configuration, in the defrost mode, it is possible to discharge the refrigerant within the refrigerant tank 14, which is to be excessive refrigerant in the heating mode, from the refrigerant tank 14 and circulate the refrigerant in the main circuit. Therefore, it is possible to increase the defrost ability, and it is possible to end the defrost mode in a short time. In addition, in the defrost mode, it is possible to collect again the refrigerant released from the refrigerant tank 14, within the refrigerant tank 14. Therefore, it is possible to decrease the amount of the refrigerant circulating in the main circuit, and inhibit liquid backflow from the second heat exchanger 6 serving as an evaporator in the heating mode in returning from the defrost mode to the heating mode. Thus, it is possible to inhibit breakdown of the compressor 2 even when the accumulator 7 is not provided or the size of the accumulator 7 is reduced.

The refrigeration cycle apparatus 1 may include the high-pressure saturation temperature detection unit configured to detect the saturation temperature of the refrigerant at the discharge side of the compressor 2, and the controller 20 may start the refrigerant collection operation when a detected temperature of the high-pressure saturation temperature detection unit rises to a defrost end determination threshold.

According to this configuration, it is possible to end the defrost mode in a time following the amount of frost formed in the first heat exchanger 4.

The controller 20 may end the refrigerant release operation when the degree of superheat at the suction side of the compressor 2 falls to a liquid discharge end determination threshold.

According to this configuration, it is possible to end the refrigerant release operation so as to follow the amount of the refrigerant within the refrigerant tank 14.

The controller 20 may detect an amount of the refrigerant within the refrigerant tank 14 based on the degree of superheat at the suction side of the compressor 2, and may end the refrigerant collection operation based on a detection result of the amount of the refrigerant within the refrigerant tank 14.

According to this configuration, it is possible to end the refrigerant collection operation so as to follow the amount of the refrigerant within the refrigerant tank 14.

Since the amount of the refrigerant within the refrigerant tank 14 is detected based on the degree of superheat at the suction side of the compressor 2 used in controlling various actuators of the refrigeration cycle apparatus 1, it is not necessary to provide an additional component for detecting the amount of the refrigerant within the refrigerant tank 14.

The refrigeration cycle apparatus 1 may include the liquid amount detection device 17 configured to detect a liquid amount within the refrigerant tank 14, and the controller 20 may end the refrigerant collection operation based on a detection result of the amount of the refrigerant within the refrigerant tank 14 based on a detection value of the liquid amount detection device 17.

The liquid amount detection device 17 may include the timer, and the controller 20 may detect the amount of the refrigerant within the refrigerant tank 14 based on a counted time of the timer.

The liquid amount detection device 17 may include the liquid level sensor configured to detect a liquid surface level within the refrigerant tank 14, and the controller 20 may detect the amount of the refrigerant within the refrigerant tank 14 based on a detection value detected by the liquid level sensor.

The liquid amount detection device 17 may include the sound collection sensor mounted to the valve 15, and the controller 20 may detect the amount of the refrigerant within the refrigerant tank 14 based on a noise value detected by the sound collection sensor.

According to this configuration, it is possible to end the refrigerant collection operation so as to follow the amount of the refrigerant within the refrigerant tank 14. In addition, since it is possible to more accurately detect the amount of the refrigerant within the refrigerant tank 14, it is possible to enhance the effect of inhibiting liquid backflow.

In the defrost mode, after the refrigerant release operation and before the refrigerant collection operation, the controller 20 may perform the defrost continuation operation of closing the second pressure reducing device 13 and the valve 15, with the flow path switching device retained to form the first flow path.

According to this configuration, since the refrigerant circulates only in the main circuit, without circulating in the refrigerant tank circuit 12, during the defrost continuation operation, it is possible to increase the speed of defrosting.

The invention claimed is:

1. A refrigeration cycle apparatus comprising:

a compressor;

a first heat exchanger;

a second heat exchanger connected in series with the first heat exchanger and having a capacity smaller than the first heat exchanger;

a first pressure reducing valve connected between the first heat exchanger and the second heat exchanger;

a flow path switching valve configured to form a first flow path through which refrigerant released from the compressor flows to the first heat exchanger in a cooling mode and a defrost mode, and form a second flow path through which the refrigerant released from the compressor flows to the second heat exchanger in a heating mode;

a refrigerant tank circuit branching from between the first heat exchanger and the first pressure reducing valve and joining between the first pressure reducing valve and the second heat exchanger, being in parallel with the first pressure reducing valve, and including, in series, a second pressure reducing valve, a refrigerant tank, and a valve, the valve opening and closing a flow path between the refrigerant tank and the second heat exchanger; and a controller configured to control the flow path switching valve, the second pressure reducing valve, and the valve, wherein when the defrost mode is started, the first pressure reducing valve being configured to adjust a flow rate of the refrigerant to bring a degree of superheat of the refrigerant at a suction side of the compressor close to a target value, and the controller is configured to control the flow path switching valve to form the first flow path, perform a refrigerant release operation of opening the second pressure reducing valve and closing the valve to cause the refrigerant within the refrigerant tank to flow in between the first heat exchanger and the first pressure reducing valve, and perform a refrigerant collection operation of opening the second pressure reducing valve and the valve, with the flow path switching valve retained to form the first flow path after the refrigerant release operation.

2. The refrigeration cycle apparatus of claim 1, wherein the controller is configured to, in the defrost mode and after the refrigerant release operation and before the refrigerant collection operation, perform a defrost continuation operation of closing the second pressure reducing valve and the valve, with the flow path switching valve retained to form the first flow path.

3. A refrigeration cycle apparatus comprising:

a compressor;

a first heat exchanger;

a second heat exchanger connected in series with the first heat exchanger and having a capacity smaller than the first heat exchanger;

a first pressure reducing valve connected between the first heat exchanger and the second heat exchanger;

a flow path switching valve configured to form a first flow path through which refrigerant released from the compressor flows to the first heat exchanger in a cooling mode and a defrost mode, and form a second flow path through which the refrigerant released from the compressor flows to the second heat exchanger in a heating mode;

a refrigerant tank circuit branching from between the first heat exchanger and the first pressure reducing valve and joining between the first pressure reducing valve and the second heat exchanger, being in parallel with the first pressure reducing valve, and including, in series, a second pressure reducing valve, a refrigerant tank, and a valve, the valve opening and closing a flow path between the refrigerant tank and the second heat exchanger; and a controller configured to control the flow path switching valve, the second pressure reducing valve, and the valve, wherein when the defrost mode is started, the first pressure reducing valve being configured to adjust a flow rate of the refrigerant to bring a degree of superheat of the refrigerant at a suction side of the compressor close to a target value, the controller being configured to control the flow path switching valve to form the first flow path, perform a refrigerant release operation, and perform a refrigerant collection operation of opening the second pressure reducing valve and the valve, with the flow path switching valve retained to form the first flow path after the refrigerant release operation, and the controller is further configured to, in the refrigerant release operation, open the second pressure reducing valve and close the valve to cause the refrigerant within the refrigerant tank to flow in between the first heat exchanger and the first pressure reducing valve, and then close the second pressure reducing valve and open the valve to cause the refrigerant within the refrigerant tank to flow in, via the valve, between the first pressure reducing valve and the second heat exchanger.

4. A refrigeration cycle apparatus comprising:

a compressor;

a first heat exchanger;

a second heat exchanger connected in series with the first heat exchanger and having a capacity smaller than the first heat exchanger;

a first pressure reducing valve connected between the first heat exchanger and the second heat exchanger;

a flow path switching valve configured to form a first flow path through which refrigerant released from the compressor flows to the first heat exchanger in a cooling mode and a defrost mode, and form a second flow path through which the refrigerant released from the compressor flows to the second heat exchanger in a heating mode;

a refrigerant tank circuit branching from between the first heat exchanger and the first pressure reducing valve and joining between the first pressure reducing valve and the second heat exchanger, being in parallel with the first pressure reducing valve, and including, in series, a second pressure reducing valve, a refrigerant tank, and a valve, the valve opening and closing a flow path between the refrigerant tank and the second heat exchanger; and a controller configured to control the flow path switching valve, the second pressure reducing valve, and the valve, wherein when the defrost mode is started, the first pressure reducing valve being configured to adjust a flow rate of the refrigerant to bring a degree of superheat of the refrigerant at a suction side of the compressor close to a target value, the controller is configured to control the flow path switching valve to form the first flow path, perform a refrigerant release operation, and perform a refrigerant collection operation of opening the second pressure reducing valve and the valve, with the flow path switching valve retained to form the first flow path after the refrigerant release operation, and the controller is further configured to, in the refrigerant release operation, close the second pressure reducing valve and open the valve to cause the refrigerant within the refrigerant tank to flow in, via the valve, between the first pressure reducing valve and the second heat exchanger, and then, open the second pressure reducing valve and close the valve to cause the refrigerant within the refrigerant tank to flow in between the first heat exchanger and the first pressure reducing valve.

5. A refrigeration cycle apparatus comprising:

a compressor;

a first heat exchanger;

a second heat exchanger connected in series with the first heat exchanger and having a capacity smaller than the first heat exchanger;

a first pressure reducing valve connected between the first heat exchanger and the second heat exchanger;

a flow path switching valve configured to form a first flow path through which refrigerant released from the compressor flows to the first heat exchanger in a cooling mode and a defrost mode, and form a second flow path through which the refrigerant released from the compressor flows to the second heat exchanger in a heating mode;

a refrigerant tank circuit branching from between the first heat exchanger and the first pressure reducing valve and joining between the first pressure reducing valve and the second heat exchanger, being in parallel with the first pressure reducing valve, and including, in series, a second pressure reducing valve, a refrigerant tank, and a valve, the valve opening and closing a flow path between the refrigerant tank and the second heat exchanger;

a controller configured to control the flow path switching valve, the second pressure reducing valve, and the valve, and a high-pressure saturation temperature detection unit configured to detect a saturation temperature of the refrigerant at a discharge side of the compressor, wherein when the defrost mode is started, the first pressure reducing valve being configured to adjust a flow rate of the refrigerant to bring a degree of superheat of the refrigerant at a suction side of the compressor close to a target value, the controller is configured to control the flow path switching valve to form the first flow path, perform a refrigerant release operation of opening one of the second pressure reducing valve and the valve and closing an other of the second pressure reducing valve and the valve, and perform a refrigerant collection operation of opening the second pressure reducing valve and the valve, with the flow path switching valve retained to form the first flow path after the refrigerant release operation, and the controller is further configured to start the refrigerant collection operation when a detected temperature of the high-pressure saturation temperature detection unit rises to a defrost end determination threshold.

6. A refrigeration cycle apparatus comprising:

a compressor;

a first heat exchanger;

a second heat exchanger connected in series with the first heat exchanger and having a capacity smaller than the first heat exchanger;

a first pressure reducing valve connected between the first heat exchanger and the second heat exchanger;

a flow path switching valve configured to form a first flow path through which refrigerant released from the compressor flows to the first heat exchanger in a cooling mode and a defrost mode, and form a second flow path through which the refrigerant released from the compressor flows to the second heat exchanger in a heating mode;

a refrigerant tank circuit branching from between the first heat exchanger and the first pressure reducing valve and joining between the first pressure reducing valve and the second heat exchanger, being in parallel with the first pressure reducing valve, and including, in series, a second pressure reducing valve, a refrigerant tank, and a valve, the valve opening and closing a flow path between the refrigerant tank and the second heat exchanger; and a controller configured to control the flow path switching valve, the second pressure reducing valve, and the valve, when the defrost mode is started, the first pressure reducing valve being configured to adjust a flow rate of the refrigerant to bring a degree of superheat of the refrigerant at a suction side of the compressor close to a target value, wherein the controller is configured to control the flow path switching valve to form the first flow path, perform a refrigerant release operation of opening one of the second pressure reducing valve and the valve and closing an other of the second pressure reducing valve and the valve, and perform a refrigerant collection operation of opening the second pressure reducing valve and the valve, with the flow path switching valve retained to form the first flow path after the refrigerant release operation, and the controller is further configured to end the refrigerant release operation when the degree of superheat at the suction side of the compressor falls to a liquid discharge end determination threshold.

7. A refrigeration cycle apparatus comprising:

a compressor;

a first heat exchanger;

a second heat exchanger connected in series with the first heat exchanger and having a capacity smaller than the first heat exchanger;

a first pressure reducing valve connected between the first heat exchanger and the second heat exchanger;

a flow path switching valve configured to form a first flow path through which refrigerant released from the compressor flows to the first heat exchanger in a cooling mode and a defrost mode, and form a second flow path through which the refrigerant released from the compressor flows to the second heat exchanger in a heating mode;

a refrigerant tank circuit branching from between the first heat exchanger and the first pressure reducing valve and joining between the first pressure reducing valve and the second heat exchanger, being in parallel with the first pressure reducing valve, and including, in series, a second pressure reducing valve, a refrigerant tank, and a valve, the valve opening and closing a flow path between the refrigerant tank and the second heat exchanger; and a controller configured to control the flow path switching valve, the second pressure reducing valve, and the valve, when the defrost mode is started, the first pressure reducing valve being configured to adjust a flow rate of the refrigerant to bring a degree of superheat of the refrigerant at a suction side of the compressor close to a target value, wherein the controller is configured to control the flow path switching valve to form the first flow path, perform a refrigerant release operation of opening one of the second pressure reducing valve and the valve and closing an other of the second pressure reducing valve and the valve, and perform a refrigerant collection operation of opening the second pressure reducing valve and the valve, with the flow path switching valve retained to form the first flow path after the refrigerant release operation, and the controller is further configured to detect an amount of the refrigerant within the refrigerant tank based on the degree of superheat at the suction side of the compressor, and end the refrigerant collection operation based on a detection result of the amount of the refrigerant within the refrigerant tank.

8. A refrigeration cycle apparatus comprising:

a compressor;

a first heat exchanger;

a second heat exchanger connected in series with the first heat exchanger and having a capacity smaller than the first heat exchanger;

a first pressure reducing valve connected between the first heat exchanger and the second heat exchanger;

a flow path switching valve configured to form a first flow path through which refrigerant released from the compressor flows to the first heat exchanger in a cooling mode and a defrost mode, and form a second flow path through which the refrigerant released from the compressor flows to the second heat exchanger in a heating mode;

a refrigerant tank circuit branching from between the first heat exchanger and the first pressure reducing valve and joining between the first pressure reducing valve and the second heat exchanger, being in parallel with the first pressure reducing valve, including, in series, a second pressure reducing valve, a refrigerant tank, and a valve, the valve opening and closing a flow path between the refrigerant tank and the second heat exchanger; and a controller configured to control the flow path switching valve, the second pressure reducing valve, and the valve, and a liquid amount detection device configured to detect a liquid amount within the refrigerant tank, wherein when the defrost mode is started, the first pressure reducing valve being configured to adjust a flow rate of the refrigerant to bring a degree of superheat of the refrigerant at a suction side of the compressor close to a target value, the controller is configured to control the flow path switching valve to form the first flow path, perform a refrigerant release operation of opening one of the second pressure reducing valve and the valve and closing an other of the second pressure reducing valve and the valve, and perform a refrigerant collection operation of opening the second pressure reducing valve and the valve, with the flow path switching valve retained to form the first flow path after the refrigerant release operation, and the controller is further configured to end the refrigerant collection operation based on a detection result of the amount of the refrigerant within the refrigerant tank based on a detection value of the liquid amount detection device.

9. The refrigeration cycle apparatus of claim 8, wherein the liquid amount detection device includes a timer, and the controller is configured to detect the amount of the refrigerant within the refrigerant tank based on a counted time of the timer.

10. The refrigeration cycle apparatus of claim 8, wherein the liquid amount detection device includes a liquid level sensor configured to detect a liquid surface level within the refrigerant tank, and the controller is configured to detect the amount of the refrigerant within the refrigerant tank based on a detection value detected by the liquid level sensor.

11. The refrigeration cycle apparatus of claim 8, wherein the liquid amount detection device includes a sound collection sensor mounted to the valve, and the controller is configured to detect the amount of the refrigerant within the refrigerant tank based on a noise value detected by the sound collection sensor.

* * * * *